US009098002B2

(12) United States Patent
Kenmoku et al.

(10) Patent No.: US 9,098,002 B2
(45) Date of Patent: Aug. 4, 2015

(54) TONER

(75) Inventors: Takashi Kenmoku, Mishima (JP); Hitoshi Itabashi, Yokohama (JP); Akane Masumoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 14/115,866

(22) PCT Filed: May 17, 2012

(86) PCT No.: PCT/JP2012/063237

§ 371 (c)(1), (2), (4) Date: Nov. 5, 2013

(87) PCT Pub. No.: WO2012/157780

PCT Pub. Date: Nov. 22, 2012

(65) Prior Publication Data

US 2014/0087299 A1 Mar. 27, 2014

(30) Foreign Application Priority Data

May 18, 2011 (JP) ..... 2011-111618

(51) Int. Cl.
*G03G 9/08* (2006.01)
*G03G 9/097* (2006.01)

(Continued)

(52) U.S. Cl.
CPC ..... *G03G 9/09733* (2013.01); *G03G 9/0806* (2013.01); *G03G 9/0815* (2013.01);
(Continued)

(58) Field of Classification Search
CPC ..... G03G 9/08711; G03G 9/09733
USPC ..... 430/108.4, 109.3
See application file for complete search history.

(56) References Cited

U.S. PATENT DOCUMENTS 5,766,814 A 6/1998 Baba et al.
5,985,502 A 11/1999 Ayaki et al.

(Continued)

FOREIGN PATENT DOCUMENTS

JP 4-16858 A 1/1992
JP 7-152207 A 6/1995

(Continued)

OTHER PUBLICATIONS

PCT International Search Report and Written Opinion of the International Searching Authority, International Application No. PCT/JP2012/063237, Mailing Date Jul. 31, 2012.

(Continued)

*Primary Examiner* — Mark A Chapman
(74) *Attorney, Agent, or Firm* — Fitzpatrick, Cella, Harper and Scinto

(57) ABSTRACT

A toner including toner particles, each of which comprising a charging component, a polymer having a partial structure represented by the following formula (1) as the side chain, and a colorant:

Formula (1)

($R^1$ represents a hydroxyl group, a carboxyl group, an alkyl group having 1 to 18 carbon atoms, or an alkoxyl group having 1 to 18 carbon atoms; $R^2$ represents a hydrogen atom, a hydroxyl group, an alkyl group having 1 to 18 carbon atoms, or an alkoxyl group having 1 to 18 carbon atoms; m represents an integer of 0 to 3; if m is 2 or 3, $R^1$ can be each independently selected; n represents an integer of 1 to 3; and * represents a coupling site in the polymer.)

7 Claims, 1 Drawing Sheet

(51) Int. Cl.
*G03G 9/087* (2006.01)
*G03G 9/093* (2006.01)

(52) U.S. Cl.
CPC ..... *G03G9/08706* (2013.01); *G03G 9/08708* (2013.01); *G03G 9/08711* (2013.01); *G03G 9/08722* (2013.01); *G03G 9/08726* (2013.01); *G03G 9/08733* (2013.01); *G03G 9/08791* (2013.01); *G03G 9/09321* (2013.01)

(56) References Cited

U.S. PATENT DOCUMENTS

| | | | |
|---|---|---|---|
| 6,106,990 | A | 8/2000 | Tazawa et al. |
| 6,124,070 | A | 9/2000 | Baba et al. |
| 6,358,658 | B1 | 3/2002 | Tazawa et al. |
| 6,566,028 | B2 | 5/2003 | Tazawa et al. |
| 6,808,855 | B2 | 10/2004 | Ayaki et al. |
| 7,252,917 | B2 | 8/2007 | Ohno et al. |
| 7,323,282 | B2 | 1/2008 | Ohno et al. |
| 7,682,765 | B2 | 3/2010 | Sugawa et al. |
| 7,718,338 | B2 | 5/2010 | Fujimoto et al. |
| 8,574,801 | B2 | 11/2013 | Itabashi et al. |
| 8,609,312 | B2 | 12/2013 | Itabashi et al. |
| 2011/0159425 | A1 | 6/2011 | Itabashi et al. |
| 2014/0072908 | A1 | 3/2014 | Masumoto et al. |
| 2014/0106272 | A1 | 4/2014 | Kenmoku et al. |

FOREIGN PATENT DOCUMENTS

| | | | |
|---|---|---|---|
| JP | 8-6297 | A | 1/1996 |
| JP | 8-30017 | A | 2/1996 |
| JP | 2002-287429 | A | 10/2002 |
| JP | 2004-219507 | A | 8/2004 |
| JP | 2006-309195 | A | 11/2006 |
| JP | 2008-304723 | A | 12/2008 |
| JP | 2010-185907 | A | 8/2010 |
| WO | 2006/104224 | A1 | 10/2006 |

OTHER PUBLICATIONS

European Search Report dated Oct. 9, 2014 in European Application No. 12786671.3.

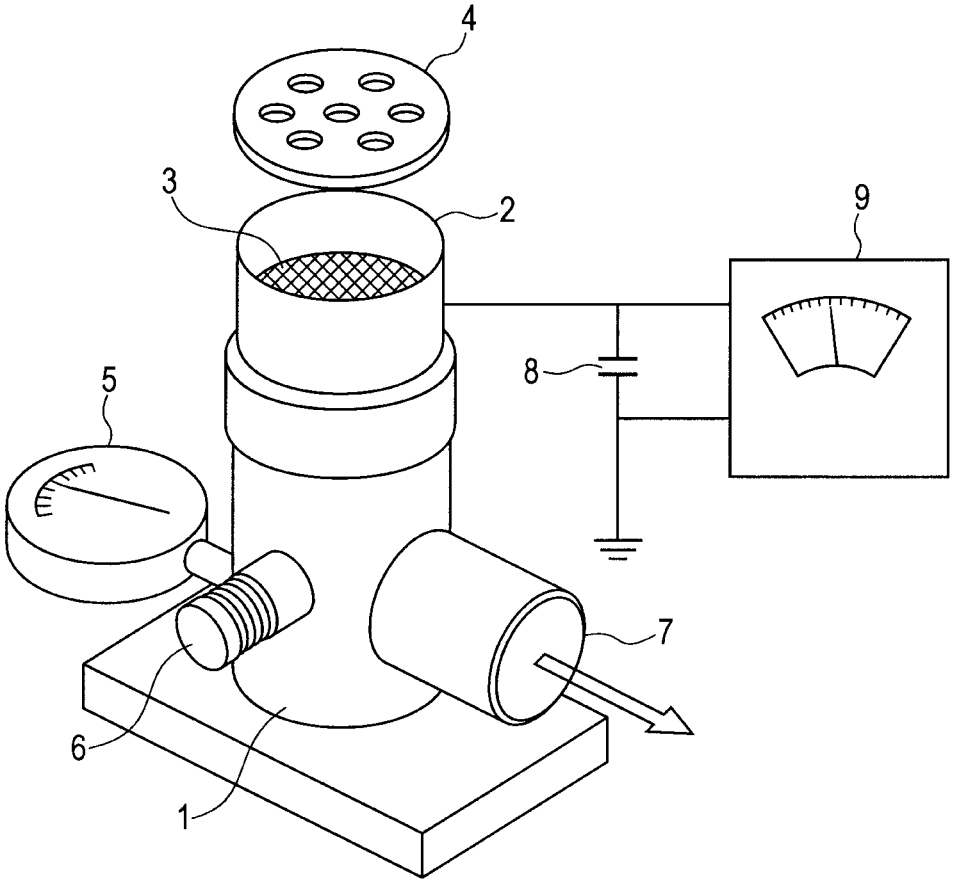
4
3
2
9
8
5
7
6
1

TONER

TECHNICAL FIELD

The present invention relates to a toner for developing an electrostatically charged image in image forming methods such as electrophotography and electrostatic printing, or a toner for forming a toner image in a toner jet image forming method.

BACKGROUND ART

Recently, printers and copiers having a higher speed and higher stability have been desired. Moreover, it has been desired to reduce the number of parts because of a demand for further downsizing which is accompanied by higher functions of the parts. In order to obtain a stable density of an image in the electrophotography, a constant developing condition needs to be always provided in a developing process. Whenever the amount of the toner to be charged is unstable, however, a developing bias condition or the like needs to be optimized, for example. Such optimization gives large load to a system for controlling developing properties, often leading to increase in the size of the apparatus or increase in production cost. In order to reduce such load, there has been a demand for improvement in stability of the amount of the toner to be charged, and particularly stability of charging against change in a temperature and humidity.

A variety of proposals for improving environmental stability of the amount of the toner to be charged have been made. Among these, control by a charge control agent prevails, and toners containing a calixarene compound, those using an iron-containing azo dye, and those using an organic boron compound have been proposed (for example, PTLs 1 to 4).

CITATION LIST

Patent Literature

PTL 1: Japanese Patent Application Laid-Open No. H07-152207

PTL 2: Japanese Patent Application Laid-Open No. H08-006297

PTL 3: Japanese Patent Application Laid-Open No. 2002-287429

PTL 4: Japanese Patent Application Laid-Open No. 2004-219507

SUMMARY OF INVENTION

Technical Problem

The toners above, however, remain insufficient with respect to stability of the amount of the toner to be charged and the rise property thereof accompanied by change in a temperature and humidity environment surrounding the toner, and may cause change in the density of an image during printing. Particularly under a high temperature and high humidity, deficits such as fogging in an image accompanied by uneven distribution of the toner to be charged may be produced.

Accordingly, an object of the present invention is to provide a toner in which the amount of the toner to be charged and rise of the amount of the toner to be charged are hardly influenced by change in a temperature or humidity.

Solution to Problem

The present invention relates to a toner including toner particles, each of which comprising a charging component and a colorant, wherein the toner contains a polymer having a partial structure represented by the following formula (1) as a side chain:

Formula (1)

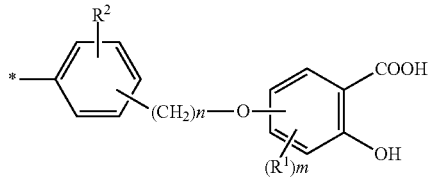

(wherein $R^1$ represents a hydroxyl group, a carboxyl group, an alkyl group having not less than 1 and not more than 18 carbon atoms, or an alkoxyl group having not less than 1 and not more than 18 carbon atoms; $R^2$ represents a hydrogen atom, a hydroxyl group, an alkyl group having not less than 1 and not more than 18 carbon atoms, or an alkoxyl group having not less than 1 and not more than 18 carbon atoms; m represents an integer of not less than 0 and not more than 3; if m is 2 or 3, $R^1$ can be each independently selected; n represents an integer of not less than 1 and not more than 3; and * represents a coupling site in the polymer.)

Advantageous Effects of Invention

The present invention can provide a toner in which the amount of the toner to be charged and rise of the amount of the toner to be charged are hardly influenced by change in a temperature or humidity environment.

Further features of the present invention will become apparent from the following description of exemplary embodiments with reference to the attached drawings.

BRIEF DESCRIPTION OF DRAWING

FIG. 1 is a drawing illustrating a configuration of an apparatus used for measuring a frictional charging amount of a developer containing a toner.

DESCRIPTION OF EMBODIMENTS

The present inventors found out that if a toner particle having a frictional charging ability contains a polymer having a salicylic acid structure represented by the following formula (1) in the side chain, the saturated charging amount and the rise property of the charging amount relative to the frequency of friction hardly depend on a temperature and humidity environment, and have achieved the present invention.

Formula (1)

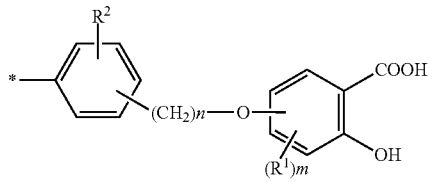

(wherein $R^1$ represents a hydroxyl group, a carboxyl group, an alkyl group having not less than 1 and not more than 18 carbon atoms, or an alkoxyl group having not less than 1 and not more than 18 carbon atoms; $R^2$ represents a hydrogen atom, a hydroxyl group, an alkyl group having not less than 1 and not more than 18 carbon atoms, or an alkoxyl group having not less than 1 and not more than 18 carbon atoms; m represents an integer of not less than 0 and not more than 3; if m is 2 or 3, $R^1$ can be each independently selected; n represents an integer of not less than 1 and not more than 3; and * represents a coupling site in the polymer.)

In the formula (1), the alkyl group and the alkoxyl group may have any substituent that does not inhibit affinity with a binder resin in the toner.

Usually, frictionally charged charges generated on the surface of the toner are likely to be influenced by the absolute amount of moisture in the surface of the toner. The reason is thought as follows. Water molecules are greatly involved in provision and reception of charges. If the frequency of desorption of water molecules in the surface of the toner is increased under a high humidity, a leakage rate of the charges is increased, reducing the saturated charging amount or the rise rate of the charging amount.

As in the present invention, however, if the toner includes toner particles, each of which comprising a charging component and a colorant, and the component having the structure above exists in the toner particles, the toner can stably keep the charges generated by frictional charging on the surface of the toner even under a high temperature and high humidity, and is less likely to be influenced by the temperature and humidity from the outside.

Although the reason still remains unclear, the present inventors think as follows. It is thought that broadening of the conjugated system such as an oxygen atom and an aryl group, which exists in the component having the structure above, improves the rate of donating charges to and receiving charges from the binder resin or a charging member to increase the rise property of the charge. On the other hand, an effect of quickly releasing the charges in the case of excessive charges (overcharging) to prevent local overcharging is expected.

The structure represented by the formula (1) has a structure in which an aromatic ring is bonded to a salicylic acid structure via alkylether having advantages in conduction of electrons. It is thought that the large conjugated system structure extending from a salicylic acid derivative plays a role in minimizing the influence of the temperature and humidity from the outside and keeping the charges generated by frictional charging within the molecule, thereby to give stable charging properties to the toner.

The toner according to the present invention needs to contain the polymer having the structure represented by the formula (1) and a charging component. The charging component may be any component that increases the frictional charging amount as the toner. For example, a binder resin having a polarity or a compound known as a charge control agent having a positive or negative charging property can be used.

The toner according to the present invention can be produced by a variety of production methods. For example, the toner can be produced by suspension polymerization in which a polymerizable monomer composition containing a polymerizable monomer, a colorant, and other desired component (such as a mold release agent and a charge control agent) is prepared, granulated in an aqueous medium, and polymerized to obtain toner particles.

In the case where the toner particles are produced by the suspension polymerization, the charging component can be efficiently localized in the vicinity of the surface of the toner in the step of granulation in the aqueous medium (granulating step). Moreover, in the case where the toner particles are produced by the suspension polymerization, a radical polymerization reaction is made using a compound represented by the formula (3) and having a vinyl group as a part of the polymerizable monomer. Thereby, the polymer having the structure A in the formula (1) in the side chain can be taken in as the binder resin. At this time, it is expected that because of the structure, the polymer having the structure A in the formula (1) is more hydrophilic than other toner composition (for example, a binder resin or a mold release agent containing no polymer having the structure A in the formula (1)). For this, it is thought that the polymer having the structure A in the formula (1) is localized in the vicinity of the surface of the toner particles. It is thought that if the charging component and the polymer having the structure A in the formula (1) are efficiently localized in the vicinity of the surface of the toner, the overcharges accumulated in the charging component existing in the vicinity of the surface of the toner are quickly dissipated into the toner to suppress excessive charging of the toner. It is thought that this action provides uniform distribution in the charging amount for each toner particle, leading to particularly quick rise of charging.

Formula (3)

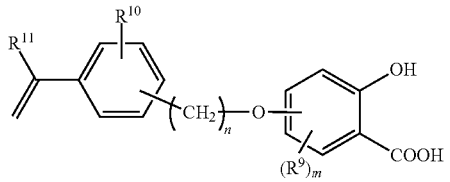

(wherein $R^9$ represents a hydroxyl group, a carboxyl group, an alkyl group having not less than 1 and not more than 18 carbon atoms, or an alkoxyl group having not less than 1 and not more than 18 carbon atoms; $R^{10}$ represents a hydrogen atom, a hydroxyl group, an alkyl group having not less than 1 and not more than 18 carbon atoms, or an alkoxyl group having not less than 1 and not more than 18 carbon atoms; $R^{11}$ represents a hydrogen atom or a methyl group; m represents an integer of not less than 0 and not more than 3; if m is 2 or 3, $R^9$ can be each independently selected; n represents an integer of not less than 1 and not more than 3.)

In the case where the toner is produced by the suspension polymerization, instead of the compound represented by the formula (3) and having a vinyl group, a polymer having the structure A in the formula (1) in the side chain and synthesized in advance can be dissolved in a polymerizable monomer and used. The same effect can also be obtained in this case.

Alternatively, the toner according to the present invention can be produced by seed polymerization: a polymerizable monomer composition containing a polymerizable monomer is added into and impregnated with an aqueous medium having core particles dispersed, and polymerized with the core particles to obtain toner particles. The core particles for the seed polymerization can be produced by a method such as kneading and crushing, suspension polymerization, dissolution and suspension, or emulsion and aggregation. In the case where the toner particles are produced by the seed polymerization, the compound represented by the formula (3) and having a vinyl group is used as the polymerizable monomer, and mixed with the core particles. The mixture is radically polymerized. Thereby, the polymer having the structure A in the formula (1) in the side chain can be taken in as the binder resin. By the seed polymerization, the polymer having the structure A in the formula (1) in the side chain can be localized in the vicinity of the surfaces of the toner particles. It is thought that for this reason, the overcharges accumulated in the charging component existing in the vicinity of the surface of the toner are quickly dissipated into the toner to suppress excessive charging of the toner. It is thought that this action provides uniform distribution of the charging amount for each toner particle, leading to particularly quick rise of charging.

Specific examples of the compound represented by the formula (3) and having a vinyl group are shown in Table 1. The examples shown here are only examples, and the compound will not be limited to these.

TABLE 1

| Polymerizable monomer | Formula | R9 H, OH, COOH alkyl group or alkoxy group having 1 to 18 carbon atoms | R10 H, OH, COOH, alkyl group or alkoxy group having 1 to 18 carbon atoms | R11 H or methyl group | m 1-3 | n 1-3 |
|---|---|---|---|---|---|---|
| M-1 | 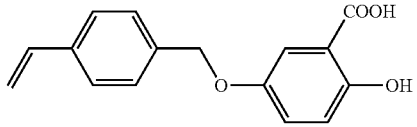 | H | H | H | 1 | 1 |
| M-2 | 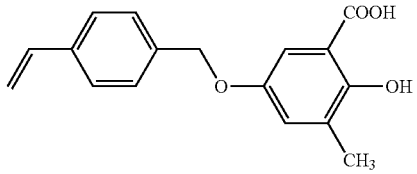 | 3-Me | H | H | 1 | 1 |
| M-3 | 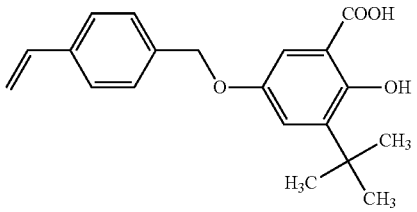 | 3-tert-Butyl | H | H | 1 | 1 |
| M-4 | 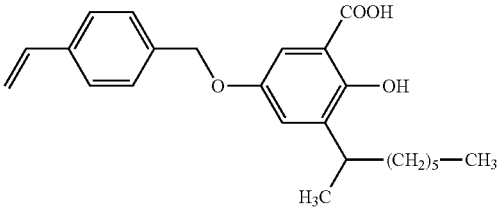 | 3-iso-Octyl | H | H | 1 | 1 |
| M-5 | 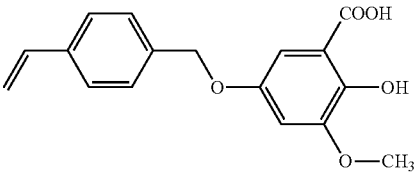 | 3-MeO | H | H | 1 | 1 |
| M-6 | 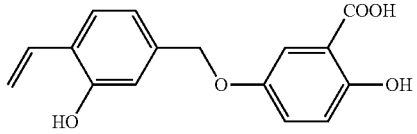 | H | 3-OH | H | 1 | 1 |
| M-7 | 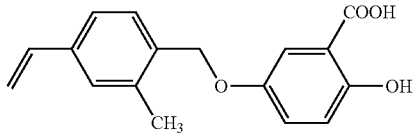 | H | 2-Me | H | 1 | 1 |

TABLE 1-continued

| Polymerizable monomer | Formula | R9 H, OH, COOH alkyl group or alkoxy group having 1 to 18 carbon atoms | R10 H, OH, COOH, alkyl group or alkoxy group having 1 to 18 carbon atoms | R11 H or methyl group | m 1-3 | n 1-3 |
|---|---|---|---|---|---|---|
| M-8 | 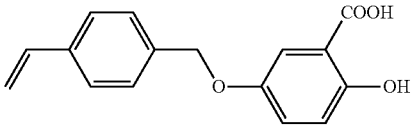 | H | H | H | 1 | 1 |
| M-9 | 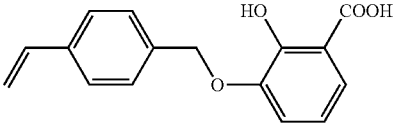 | H | H | H | 1 | 1 |
| M-10 | 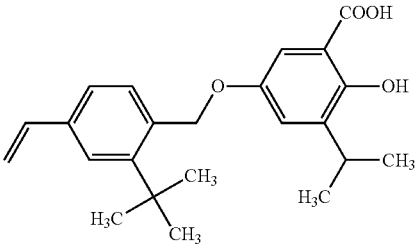 | 3-iso-Propyl | 2-tert-Butyl | H | 1 | 1 |
| M-11 | 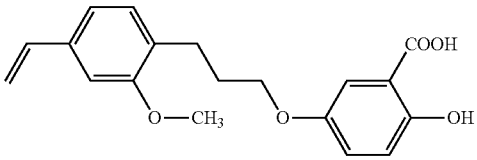 | H | 2-MeO | H | 1 | 3 |

A basic resin structure of the polymer having the structure A in the formula (1) is not particularly limited as long as it is a structure in which the structure A can be coupled at the * site. Examples of the polymer include vinyl polymers, polyester polymers, polyamide polymers, polyurethane polymers, and polyether polymers. Examples of the polymer also include hybrid polymers in combination of two or more of these. Among these, preferred are vinyl polymers and polyester polymers in consideration of easiness in production, merits of cost, and affinity with the binder resin. In the polymer, the partial structure represented by the formula (1) has only one bonding site. For this, the partial structure represented by the formula (1) is bonded as the side chain. The side chain may be a side chain bonded to the main chain. Alternatively, the side chain may be bonded to other side chain that is bonded to the main chain and has other structure, and may be a side chain of the other side chain.

In the case of the toner particles produced by the suspension polymerization or the toner particles produced by the seed polymerization, the polymer having the structure A in the formula (1) in the side chain can be produced by adding the compound represented by the formula (3) and having a vinyl group as the polymerizable monomer component during production of the toner particles. At this time, in addition of the compound represented by the formula (3), a vinyl monomer can be further added to the polymerizable monomer component to form a copolymer.

At this time, the vinyl monomer is not particularly limited. Specifically, examples of the vinyl monomer include styrenes such as styrene, o-methylstyrene, m-methylstyrene, p-methylstyrene, and α-methylstyrene and derivatives thereof; ethylene unsaturated monoolefins such as ethylene, propylene, butylene, and isobutylene; halogenated vinyls such as vinyl chloride, vinylidene chloride, vinyl bromide, and vinyl fluoride; vinyl ester acids such as vinyl acetate, vinyl propionate, and vinyl benzoate; acrylic acid esters such as n-butyl acrylate and 2-ethylhexyl acrylate; methacrylic acid esters such as n-butyl methacrylate and 2-ethylhexyl methacrylate; methacrylic acid amino esters such as dimethylaminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinyl pyrrole; vinylnaphthalenes; acrylic acid or methacrylic acid derivatives such as acrylonitrile, (meth)acrylonitrile, and acrylamide; and acrylic acids and methacrylic acids. When necessary, two or more of the vinyl monomers may be used in combination. Moreover, a known crosslinking agent may be added.

Examples of a polymerization initiator usable for polymerization of the polymerizable monomer component above include various polymerization initiators such as peroxide polymerization initiators and azo polymerization initiators. Examples of organic peroxide polymerization initiators include peroxy esters, peroxydicarbonates, dialkyl peroxides, peroxyketals, ketone peroxides, hydroperoxides, and diacyl peroxides. Examples of inorganic peroxide polymerization initiators include persulfate and hydrogen peroxide. Specifically, examples thereof include peroxyesters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butyl peroxyisopropyl monocarbonate, and t-butyl peroxy 2-ethylhexylmonocarbonate; diacyl peroxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and t-butyl peroxyallylmonocarbonate. Examples of the azo polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and dimethyl-2,2'-azobis(2-methylpropionate).

When necessary, two or more of these polymerization initiators can be used at the same time. At this time, the amount of the polymerization initiator to be used is preferably not less than 0.100 parts by mass and not more than 20.0 parts by mass based on 100 parts by mass of the polymerizable monomer.

In the present invention, the weight average molecular weight of the polymer having the structure A in the formula (1) in the side chain is preferably not less than 1000 and not more than 1000000, the weight average molecular weight being calculated by gel permeation chromatography (GPC). A more preferred range of the weight average molecular weight is not less than 2000 and not more than 200000. If the molecular weight of the polymer having the structure A in the formula (1) in the side chain is within the range above, contamination of a member such as a sleeve and a carrier is well suppressed.

From the viewpoint of the charging properties and fixing properties, the polymer having the structure A in the formula (1) in the side chain preferably has narrow distribution of the molecular weight. The ratio (Mw/Mn) of the weight average molecular weight Mw to the number average molecular weight Mn, which are calculated by gel permeation chromatography, is preferably not less than 1.0 and not more than 6.0.

The molecular weight of the polymer having the structure A in the formula (1) in the side chain can be controlled by adjusting the amount of the component or the vinyl monomer to be used during production of the toner, the kind of the polymerization initiator, the amount of the polymerization initiator to be used, the reaction temperature, and the reaction time.

The content of the partial structure represented by the following formula (2) is preferably not less than 0.100 μmol and not more than 200 μmol per 1 g of the toner. If the content of the partial structure represented by the formula (2) is within the range above, a balance between hold and leakage of the charges is more suitably kept. In addition, a high charging ability is provided. The content of the partial structure represented by the formula (2) can be controlled by adjusting the amount of the component to be used during production of the toner. The content amount of the partial structure represented by the formula (2) in the toner in the after-mentioned examples is calculated by means of the amount of the compound represented by the formula (3) used in toner preparation.

Formula (2)

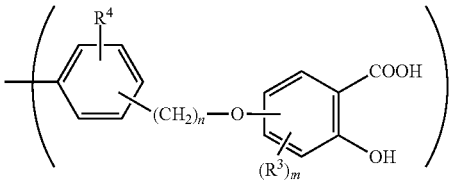

(wherein $R^3$ represents a hydroxyl group, a carboxyl group, an alkyl group having not less than 1 and not more than 18 carbon atoms, or an alkoxyl group having 1 to 18 carbon atoms; $R^4$ represents a hydrogen atom, a hydroxyl group, an alkyl group having not less than 1 and not more than 18 carbon atoms, or an alkoxyl group having not less than 1 and not more than 18 carbon atoms; m represents an integer of not less than 0 and not more than 3; if m is 2 or 3, $R^3$ can be each independently selected; and n represents an integer of not less than 1 and not more than 3.)

As described above, the toner according to the present invention needs to contain the charging component. As the charging component, a resin having a polarity may be used as the binder resin. A charge control agent can be used.

The resin having a polarity broadly means resins in which frictional charging is easy to produce, namely, provision and reception of the charges is relatively easy. Examples of the resin having a polarity can include those having an ether bond, an ester bond, or an amide bond in the resin, and those having a polar group such as a carboxyl group, a sulfonate group, and a hydroxyl group. Specifically, examples of the resin having a polarity can include polyester resins, polyether resins, polyamide resins, and styrene-acrylic resins, resins having a carboxyl group, a sulfonate group, and a hydroxyl group, and hybrid resins having these resins bonded to each other. Moreover, the vinyl polymer unit in the vinyl resin or the hybrid resin may have a crosslinking structure crosslinked by a crosslinking agent having two or more vinyl groups.

Particularly, the resin having an acid value is easy to charge, and the charging amount thereof is easy to increase. Accordingly, the resin having an acid value is effective as the toner material. Examples of the resin having an acid value include styrene-acrylic resins and polyester resins having a carboxyl group or a sulfonate group.

Among the monomers that form the styrene-acrylic resins, known monomers having a high polarity can be used. Specifically, examples thereof can include: α,β-unsaturated acids such as acrylic acid, methacrylic acid, crotonic acid, and cinnamic acid; α,β-unsaturated acid anhydrides and anhydrides of α,β-unsaturated acids and lower fatty acids such as crotonic acid anhydrides and cinnamic acid anhydrides; and monomers having a carboxyl group such as alkenyl malonic acid, alkenyl glutaric acid, alkenyl adipic acid, acid anhydrides thereof, and monoester thereof; acrylic acid esters or methacrylic acid esters such as 2-hydroxyethyl acrylate, 2-hydroxyethyl methacrylate, and 2-hydroxypropyl methacrylate; monomers having a hydroxyl group such as 4-(1-hydroxy-1-methylbutyl)styrene, 4-(1-hydroxy-1-methylhexyl)styrene; unsaturated dibasic acids such as maleic acid, citraconic acid, itaconic acid, alkenyl succinic acid, fumaric acid, and mesaconic acid; unsaturated dibasic acid anhydrides such as maleic acid anhydride, citraconic acid anhydride, itaconic acid anhydride, and alkenyl succinic acid anhydride; half esters of unsaturated dibasic acids such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenyl succinic acid methyl half ester, fumaric acid methyl half ester, and mesaconic acid methyl half ester; and monomers having an unsaturated sulfonic acid such as para-styrene sulfonic acid.

Examples of a copolymerizable monomer with the monomers having a polarity specifically include: styrenes such as styrene, o-methylstyrene, m-methylstyrene, p-methylstyrene, and α-methylstyrene, and derivatives thereof; ethylene unsaturated monoolefins such as ethylene, propylene, butylene, and isobutylene; halogenated vinyls such as vinyl chloride, vinylidene chloride, vinyl bromide, and vinyl fluoride; vinyl ester acids such as vinyl acetate, vinyl propionate, and vinyl benzoate; acrylic acid esters such as n-butyl acrylate and 2-ethylhexyl acrylate; methacrylic acid esters such as n-butyl methacrylate and 2-ethylhexyl methacrylate; methacrylic acid amino esters such as dimethylaminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinyl pyrrole; vinylnaphthalenes; and acrylic acid or methacrylic acid derivatives such as acrylonitrile, (meth)acrylonitrile, and acrylamide. When necessary, two or more of these monomers may be used in combination.

The polymerization initiator usable for production of the styrene-acrylic resin is not particularly limited, and a known peroxide polymerization initiator or azo polymerization initiator can be used. Examples thereof include the same as the polymerization initiators described above.

The polyester resin having an acid value may be a resin having a carboxyl group in the terminal, or may be a resin having a carboxyl group halfway of the molecule chain as obtained using a polyvalent carboxylic acid having functionality of 3 or more as the monomer.

Examples of alcohol components and acid components used for obtaining the polyester resin include the followings.

Examples of polyhydric alcohol components that form the polyester resin include the followings. Specifically, examples of divalent alcohol components include alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Examples of alcohol components having a valence of 3 or more include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of polyvalent carboxylic acid components include aromatic dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; succinic acid replaced by an alkyl group having not less than 6 and not more than 12 carbon atoms or anhydrides thereof; unsaturated dicarboxylic acids such as fumaric acid, maleic acid, and citraconic acid or anhydrides thereof.

Among these, particularly preferably usable are polyester resins obtained by using a bisphenol derivative as the diol component, using a carboxylic acid having a valence of 2 or more (such as fumaric acid, maleic acid, maleic anhydride, phthalic acid, terephthalic acid, trimellitic acid, and pyromellitic acid), an acid anhydride thereof, or a lower alkyl ester carboxylic acid component thereof as an acid component, and condensation polymerizing these.

Further, the polyester resin may be a hybrid resin having a polyester structure portion and a styrene-acrylic structure portion.

Examples of the hybrid resin include those having a polyester structure and a structure modified with a vinyl monomer. Examples of a method for obtaining the hybrid resin include a method using a peroxide polymerization initiator to modify the polyester resin with vinyl and a method of polymerizing a polyester resin having an unsaturated group with a vinyl monomer.

In the case where the binder resin having a polarity has an acid value, the acid value is preferably not less than 2.0 mgKOH/g and not more than 60.0 mgKOH/g. At an acid value within the range, the charging amount that the toner has is hardly influenced by environmental change, and a more suitable charging amount is obtained.

In the case of the styrene-acrylic resin, the acid value can be adjusted by controlling the amount of the monomer to be used, the monomer giving an acid value. In the case of the polyester resin, the acid value can be adjusted by adjusting the ratio of the amount of the polyhydric alcohol component to that of the polyvalent carboxylic acid component to control the amount of an acid group and that of a hydroxyl group.

Preferably, the surface of the toner particles has an acid value of not less than 0.010 mgKOH/g and not more than 1.000 mgKOH/g. It is thought that this is because the charging properties of the toner greatly depend on the acid value in the surface of the toner. The acid value in the surface of the toner particle is an acid value measured when the toner is dispersed in an aqueous medium. The measurement method will be described later. In order to control the acid value in the surface of the toner, the acid value of the resin introduced into the toner particles may be controlled. In the case of the toner particles produced through granulation in an aqueous medium, the acid value of a resin having relatively high hydrophilicity may be adjusted, the resin readily moving to the surfaces of the toner particles in the aqueous medium.

As the charge control agent used as the charging component, a known positive or negative charge control agent can be used. Examples of the charge control agents include organic metal complexes, chelate compounds, quaternary ammonium salts, nigrosine dyes, azine dyes, and triphenylmethane dyes and pigments. Examples of the organic metal complex or the chelate compound include metal compounds of monoazo dyes, acetylacetone metal compounds, aromatic dicarboxylic acid metal compounds, metal compounds of aromatic oxycarboxylic acids, and metal compounds of benzilic acid.

Particularly suitable is use of a high molecular charge control agent as the charge control agent. In the case where a polymer having a structure B represented by the formula (4) is contained as the high molecular weight charge control agent, the polymer is effective for increasing the saturated charging amount and further improving the charge rise property.

Formula (4)

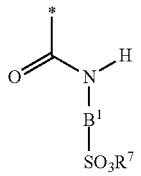

(wherein $R^7$ represents a hydrogen atom or an alkyl group having not less than 1 and not more than 12 carbon atoms; $B^1$ represents an alkylene structure that has 1 or 2 carbon atoms and may have a substituent or an aromatic ring that may have a substituent; the substituent in the alkylene structure is a hydroxyl group, an alkyl group having not less than 1 and not more than 12 carbon atoms, a phenyl group, a naphthyl group, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms; and * represents a coupling site in the polymer.)

In the formula (4), $R^7$ is more preferably a hydrogen atom or an alkyl group having not less than 1 and not more than 4 carbon atoms.

In the toner according to the present invention, the charging properties of the toner are improved if the polymer having the structure B represented by the formula (4) exists in the toner. Although the reason remains unclear, the present inventors think as follows. A charge generating mechanism by a sulfonate group and a charge accumulation function by an amide group in the structure B represented by the formula (4) increase the saturated charging amount and the charging rate, leading to quick rise of charge in the toner. On the other hand, it is thought that overcharges accumulated in the structure B are dissipated into the toner by the salicylic acid structure included in the structure A, suppressing overcharge of the toner. It is thought that this action provides uniform distribution of the charging amount in the entire toner even if the respective particles in the toner may be charged unevenly, leading to more quick rise of charge.

Examples of the polymer having the structure B represented by the formula (4) include vinyl resins having a unit represented by the formula (5).

Formula (5)

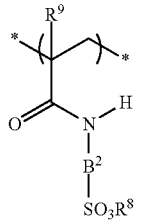

(wherein $R^8$ represents a hydrogen atom or an alkyl group having not less than 1 and not more than 12 carbon atoms; $R^9$ represents a hydrogen atom or a methyl group; $B^2$ represents an alkylene structure that has 1 or 2 carbon atoms and may have a substituent or an aromatic ring that may have a substituent; the substituent in the alkylene structure is a hydroxyl group, an alkyl group having not less than 1 and not more than 12 carbon atoms, a phenyl group, a naphthyl group, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms; and * represents a coupling site in the polymer.)

A method for producing a polymer is not particularly limited. The vinyl resin having the unit represented by the formula (5) can be produced by polymerization using a vinyl monomer represented by the formula (6).

Formula (6)

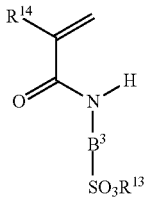

(wherein $B^3$ represents an alkylene structure that has 1 or 2 carbon atoms and may have a substituent or an aromatic ring that may have a substituent; R'3 represents a hydrogen atom or an alkyl group having not less than 1 and not more than 12 carbon atoms; R'4 represents a hydrogen atom or a methyl group; the substituent in the alkylene structure is a hydroxyl group, an alkyl group having not less than 1 and not more than 12 carbon atoms, a phenyl group, a naphthyl group, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms.)

Specific examples of the vinyl monomer represented by the formula (6) can include: 2-acrylamide-2-methylpropanesulfonic acid, 2-acrylamidebenzenesulfonic acid, 2-methacrylamidebenzenesulfonic acid, 3-acrylamidebenzenesulfonic acid, 3-methacrylamidebenzenesulfonic acid, 4-acrylamidebenzenesulfonic acid, 4-methacrylamidebenzenesulfonic acid, 2-acrylamide-5-methylbenzenesulfonic acid, 2-methacrylamide-5-methylbenzenesulfonic acid, 2-acrylamide-5-methoxybenzenesulfonic acid, 2-methacrylamide-5-methoxybenzenesulfonic acid, and alkylesters having not less than 1 and not more than 12 carbon atoms of these. Preferable are those having a sulfonic acid structure, methyl esters of these, or ethyl esters of these. More preferable are those having a sulfonic acid structure or a sulfonic acid methylester structure.

A vinyl monomer copolymerizable with the polymer having the structure B is not particularly limited. Specifically, the same vinyl monomers as those that can be mixed with the compound represented by the formula (3) and copolymerized can be used.

On the other hand, in the case where the polymer having the structure B is the polyester resin, various known production methods can be used. Examples of the methods include:

i) a method in which reaction residues of carboxyl groups and hydroxyl groups contained in the polyester structure are used and converted by an organic reaction into the structure B represented by the formula (4);

ii) a method in which polyester is produced using a polyhydric alcohol or polyvalent carboxylic acid having the structure B represented by the formula (4) as the substituent; and iii) a method in which a functional group that facilitates introduction of the structure B represented by the formula (4) as the substituent is introduced into a polyhydric alcohol or a polyvalent carboxylic acid in advance.

In the case of the hybrid resin, examples of the methods include:

iv) a method in which the polyester resin containing the structure B represented by the formula (4) as the substituent is hybridized by a vinyl monomer;

v) a method in which a vinyl monomer having a carboxyl group such as acrylic acid and methacrylic acid is polymerized, and the carboxyl group is converted into the structure B represented by the formula (4) by an organic reaction; and vi) a method in which a polyester resin is hybridized using a vinyl monomer having the structure B represented by the formula (4).

A known method can be used as the method for hybridizing a polyester resin using a vinyl monomer, and is effective as the method iv). Specifically, examples of the method include a method of vinyl modifying polyester with a peroxide initiator, and a method of graft modifying a polyester resin having an unsaturated group to produce a hybrid resin.

Examples of a specific method for v) can include a method in which when the structure B represented by the formula (4) is introduced, a carboxyl group existing in the resin is amidated using a compound having an amino group introduced into the * site in the formula (4).

As a specific method for vi), the polymerizable monomer represented by the formula (6) can be used as the vinyl monomer that can be used.

Preferably, the weight average molecular weight (Mw) of the polymer having the structure B represented by the formula (4) is not less than 1000 and not more than 1000000, the weight average molecular weight being calculated by gel permeation chromatography (GPC). A more preferred range of the weight average molecular weight (Mw) is not less than 2000 and not more than 200000. If the polymer having the structure B represented by the formula (4) has a molecular weight within the range above, contamination of a member such as a sleeve and a carrier is well suppressed.

From the viewpoint of charging properties and fixing properties, the polymer having the structure B represented by the formula (4) preferably has narrow distribution of the molecular weight. Preferably, the ratio (Mw/Mn) of the weight average molecular weight Mw to the number average molecular weight Mn is not less than 1.0 and not more than 6.0, the Mw and the Mn being calculated by gel permeation chromatography.

In the present invention, a known method can be used as a method for controlling the weight average molecular weight of the polymer having the structure B. In the case where the polymer having the structure B is the vinyl resin, the weight average molecular weight can be arbitrarily adjusted by the ratio of the amount of the vinyl monomer represented by the formula (6) to that of other vinyl monomer, the amount of the polymerization initiator to be used, and the polymerization temperature. If the polymer having the structure B is the polyester resin, the weight average molecular weight can be arbitrarily adjusted by the ratio of the amount of the acid component to be used to that of the alcohol component to be used or the polymerization time. In the hybrid resin, the molecular weight of the polyester component and the molecular weight of the vinyl modified unit can be adjusted. Specifically, the weight average molecular weight of the hybrid resin can be arbitrarily adjusted by the amount of a radical initiator or the polymerization temperature in a vinyl modification reaction step. As the vinyl monomer that can be used for hybridization of the polyester resin in the present invention, the same vinyl monomers as those that can be mixed with the compound represented by the formula (3) above and copolymerized can be used.

Moreover, in the case where the toner according to the present invention contains the polymer having the structure B, preferably, the ratio a/b of the content a (μmol) of the structure A in the formula (1) per 1 g of the toner to the content b (μmol) of the structure B represented by the formula (4) per 1 g of the toner is $0.100 \leq a/b \leq 50.0$, and the content b is not less than 0.100 μmol.

Although the reason remains unclear, the present inventors think as follows. If the content b in the toner is not less than 0.100 μmol/g, the toner has a larger amount of portions in which charges are sufficiently generated and accumulated. As a result, a desired charging amount can be given to the toner quickly. Moreover, if the molar ratio a/b of the content a of the structure A to the content b of the structure B in the toner particles is not less than 0.100 and not more than 50.0, charging is made uniform more quickly. Although the mechanism is unclear, it is thought that at a molar ratio a/b of not less than 0.100, occurrence of charge up can be more efficiently suppressed as the toner particles. Moreover, it is thought that at a molar ratio a/b of not more than 50.0, an influence of moisture absorbing properties that the structure A in the formula (1) has can be suppressed, and a desired charging amount can be given to the toner more efficiently.

In order to control the content a of the structure A and the content b of the structure B in the toner, the amounts of the respective components to be added may be adjusted.

The binder resin in the toner according to the present invention is not particularly limited. In production of the toner particles by the suspension polymerization, a polymerizable monomer can be polymerized to be formed as the binder resin. In this case, the polymerizable monomer is not particularly limited, and the vinyl monomer is suitably used. At this time, in addition to the polymerizable monomer, a vinyl resin or a polyester resin can be further added to the monomer composition to prepare a material that forms the binder resin. Examples of the vinyl resin that can be used as the binder resin in the toner according to the present invention can include: styrene resins, acrylic resins, methacrylic resins, styrene-acrylic resins, styrene-methacrylic resins, polyethylene resins, polyethylene-vinyl acetate resins, vinyl acetate resins, and polybutadiene resins.

As the polyester resin, polyester resins usually produced using polyhydric alcohol and carboxylic acid, carboxylic anhydride, or carboxylic acid ester as raw material monomers can be used. Specifically, the same polyhydric alcohol components and polyvalent carboxylic acid components as those in the description of the polyester resin can be used. Among these, particularly preferred are polyester resins obtained by condensation polymerizing the following components. Namely, the component is carboxylic acid components including bisphenol derivatives as a diol component; and lower alkylesters such as divalent or more carboxylic acids or acid anhydrides thereof; fumaric acid, maleic acid, maleic anhydride, phthalic acid, terephthalic acid, trimellitic acid, and pyromellitic acid as an acid component.

Other than the vinyl resin and the polyester resin, phenol resins, polyurethane resins, polybutyral resins, and hybrid resin obtained by arbitrarily bonding these resins can also be used.

Among these, the followings are desirably used for toner properties: styrene resins, acrylic resins, methacrylic resins, styrene-acrylic resins, styrene-methacrylic resins, polyester resins, and hybrid resins obtained by bonding a styrene-acrylic resin or a styrene-methacrylic resin to a polyester resin.

Examples of the colorant that can be used for the toner according to the present invention can include known colorants such as various conventionally known dyes and pigments in the related art.

Examples of coloring pigments for magenta include C.I. Pigment Reds 3, 5, 17, 22, 23, 38, 41, 112, 122, 123, 146, 149, 178, 179, 190, and 202, and C.I. Pigment Violets 19 and 23. These pigments may be used alone, or may be used in combination with dyes and pigments.

Examples of coloring pigments for cyan include C.I. Pigment Blues 15, 15:1, and 15:3 or copper phthalocyanine pigments having 1 to 5 phthalimidomethyl groups replaced in a phthalocyanine skeleton.

Examples of coloring pigments for yellow include C.I. Pigment Yellows 1, 3, 12, 13, 14, 17, 55, 74, 83, 93, 94, 95, 97, 98, 109, 110, 154, 155, 166, 180, and 185.

As a black colorant, carbon black, aniline black, acetylene black, titanium black, and colorants prepared by using the yellow/magenta/cyan colorants shown above and toning the color to black can be used.

Moreover, the toner according to the present invention can also be used as a magnetic toner. In this case, magnetic bodies shown below are used: iron oxides such as magnetite, maghemite, and ferrite, or iron oxides containing other metal oxide; metals such as Fe, Co, and Ni, or alloys of these metals and metals such as Al, Co, Cu, Pb, Mg, Ni, Sn, Zn, Sb, Ca, Mn, Se, and Ti, and a mixture thereof. More specifically, examples of the magnetic bodies include triiron tetraoxide ($Fe_3O_4$), diiron trioxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$). The magnetic materials above are used alone, or two or more thereof are used in combination. Particularly suitable magnetic materials are fine powder of triiron tetraoxide or $\gamma$-diiron trioxide.

These magnetic bodies preferably have an average particle size of not less than 0.1 μm and not more than 1.0 μm, and more preferably have an average particle size of not less than 0.1 μm and not more than 0.3 μm. As the magnetic properties at 795.8 kA/m (10 KOe), the coercivity (Hc) is not less than 1.6 kA/m and not more than 12 kA/m (not less than 20 Oe and not more than 150 Oe); the saturation magnetization ($\delta s$) is not less than 5 $Am^2/kg$ and not more than 200 $Am^2/kg$, and preferably not less than 50 $Am^2/kg$ and not more than 100 $Am^2/kg$. The residual magnetization ($\delta r$) is preferably not less than 2 $Am^2/kg$ and not more than 20 $Am^2/kg$.

The amount of the magnetic body to be used is preferably in the range of not less than 10 parts by mass and not more than 200 parts by mass, and more preferably the range of not less than 20 parts by mass and not more than 150 parts by mass based on 100 parts by mass of the binder resin.

The toner according to the present invention may contain a mold release agent. Examples of the mold release agent include aliphatic hydrocarbon waxes such as low molecular weight polyethylenes, low molecular weight polypropylenes, microcrystalline waxes, and paraffin waxes; oxides of aliphatic hydrocarbon waxes such as oxidized polyethylene wax; block copolymers of aliphatic hydrocarbon waxes; waxes containing fatty acid esters such as carnauba wax, Sasol wax, and montanic acid ester wax as a principal component; partially or totally deoxidized fatty acid esters such as deacidified carnauba wax and partially esterified products of fatty acids such as behenic acid monoglyceride and polyhydric alcohols; and methylester compounds having a hydroxyl group that are obtained by hydrogenating vegetable oils and fats.

In the molecular weight distribution of the mold release agent, the main peak of the molecular weight is preferably in the range of not less than 400 and not more than 2400, and more preferably in the range of not less than 430 and not more than 2000. Thereby, preferred thermal properties can be given to the toner. The total amount of the mold release agent to be added is preferably not less than 2.5 parts by mass and not more than 40.0 parts by mass, and more preferably not less than 3.0 parts by mass and not more than 15.0 parts by mass based on 100 parts by mass of the binder resin.

A method for producing toner particles is not particularly limited, and known methods can be used. As described above, the seed polymerization and the suspension polymerization are preferred.

In the method for producing toner particles by the suspension polymerization or the seed polymerization, usable dispersion media are determined according to the solubility of the binder resin, an organic medium, the polymerizable monomer, and the compound represented by the formula (3) and having a vinyl group in the dispersion medium. Aqueous dispersion media are preferred. Examples of the aqueous dispersion medium that can be used include water; alcohols such as methyl alcohol, ethyl alcohol, modified ethyl alcohol, isopropyl alcohol, n-butyl alcohol, isobutyl alcohol, tert-butyl alcohol, and sec-butyl alcohol; and ether alcohols such as methyl cellosolve, cellosolve, isopropyl cellosolve, butyl cellosolve, and diethylene glycol monobutyl ether. Besides, water soluble dispersion media are selected from ketones such as acetone, methyl ethyl ketone, and methyl isobutyl ketone; esters such as ethyl acetate; ethers such as ethyl ether and ethylene glycol; acetals such as methylal and diethyl acetal; acids such as formic acid, acetic acid, and propionic acid. Particularly preferred is water or alcohols. Two or more of these solvents can be mixed and used. The concentration of a liquid mixture or polymerizable monomer composition to the dispersion medium is preferably not less than 1% by mass and not more than 80% by mass, and more preferably not less than 10% by mass and not more than 65% by mass based on the dispersion medium.

A kwon dispersion stabilizer can be used in the case where the aqueous dispersion medium is used. Specific examples of the dispersion stabilizer include inorganic compounds such as calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. As organic compounds, polyvinyl alcohol, gelatin, methyl cellulose, methyl hydroxypropyl cellulose, ethyl cellulose, sodium salts of carboxymethyl cellulose, polyacrylic acids and salts thereof, and starch can be dispersed in an aqueous phase and used. The concentration of the dispersion stabilizer is preferably not less than 0.2 parts by mass and not more than 20.0 parts by mass based on 100 parts by mass of the liquid mixture or the polymerizable monomer composition.

A fluidity improver as an external additive may be added to the toner particles. Examples of the fluidity improver include fluorine resin powders such as vinylidene fluoride fine powder and polytetrafluoroethylene fine powder; silica fine powders such as silica fine powder produced by a wet method and silica fine powder produced by a dry method, treated silica fine powder obtained by surface treating these silica fine powders with a treatment agent such as a silane coupling agent, a titanium coupling agent, and silicone oil; titanium oxide fine powder; alumina fine powder, treated titanium oxide fine powder, and treated alumina oxide fine powder. The fluidity improver has a specific surface area of preferably not less than 30 $m^2/g$ and more preferably not less than 50 $m^2/g$, the specific surface area being measured by the BET method according to nitrogen adsorption. The amount of the fluidity improver to be added is preferably not less than 0.01 parts by mass and not more than 8.0 parts by mass, and more preferably not less than 0.1 parts by mass and not more than 4.0 parts by mass based on 100 parts by mass of the toner particles.

The weight average particle size (D4) of the toner is preferably not less than 3.0 μm and not more than 15.0 μm, and more preferably not less than 4.0 μm and not more than 12.0 μm.

The toner can be mixed with a magnetic carrier and used as a two-component developer. As the magnetic carrier, metal particles of surface-oxidized iron or non-oxidized iron, lithium, calcium, magnesium, nickel, copper, zinc, cobalt, manganese, chromium, and rare earth elements, particles of alloys thereof, particles of oxides thereof, and ferrite fine particles can be used.

In a developing method of applying an AC bias to a developing sleeve, the coated carrier having the surface of the magnetic carrier core coated with a resin is preferably used. As a coating method, used is a method of dissolving or suspending a coating material such as a resin in a solvent to prepare a coating solution and applying the coating solution to the surface of a magnetic carrier core, or a method of mixing a magnetic carrier core with a coating material in powder.

Examples of the coating material for the magnetic carrier core include silicone resins, polyester resins, styrene resins, acrylic resins, polyamides, polyvinyl butyrals, and amino acrylate resins. These are used alone, or two or more thereof are used in combination. The amount of the coating material to be used for coating treatment is not less than 0.1% by mass and not more than 30% by mass (preferably not less than 0.5% by mass and not more than 20% by mass) based on the carrier core particles. The average particle size of the magnetic carrier is preferably not less than 10 μm and not more than 100 μm, and more preferably not less than 20 μm and not more than 70 μm in terms of a volume-based 50% particle size (D50). In the case where the two-component developer is prepared, the mixing ratio of the toner in the developer in terms of a concentration is not less than 2% by mass and not more than 15% by mass, and preferably not less than 4% by mass and not more than 13% by mass. This mixing ratio provides a good result.

Hereinafter, methods for measuring physical properties will be described.

<Measurement of Molecular Weight of Resin>

The molecular weight and molecular weight distribution of the resin used in the present invention are calculated by gel permeation chromatography (GPC) in terms of polystyrene. In the case where the molecular weight of a resin having an acid group is measured, the column eluting rate also depends on the amount of the acid group. Accordingly, a sample having the acid group capped in advance needs to be prepared. Preferable capping is methyl esterification, and a commercially available methyl esterification agent can be used. Specifically, examples of methyl esterification include a method of treating with trimethylsilyldiazomethane.

The measurement of the molecular weight by GPC is performed as follows. The resin is added to THF (tetrahydrofuran), and left as it is at room temperature for 24 hours. The obtained solution is filtered with a membrane filter "MAISHORI DISK" (made by Tosoh Corporation) having a pore diameter of 0.2 μm and having solvent resistance to prepare a sample solution. The sample solution is measured on the following condition. In preparation of the sample solution, the amount of THF is adjusted such that the concentration of the resin is 0.8% by mass. If the resin is difficult to dissolve in THF, a basic solvent such as DMF can be used.

Apparatus: HLC8120 GPC (detector: RI) (made by Tosoh Corporation)

Column: 7 columns of Shodex KF-801, 802, 803, 804, 805, 806, and 807 (made by Showa Denko K.K.)

Eluent: tetrahydrofuran (THF)

Flow rate: 1.0 mL/min

Oven temperature: 40.0° C.

Amount of sample to be injected: 0.10 mL

In calculation of the molecular weight of the sample, a molecular weight calibration curve is used, which is created using standard polystyrene resin columns below. Specifically, these are trade names "TSK standard polystyrene F-850, F-450, F-288, F-128, F-80, F-40, F-20, F-10, F-4, F-2, F-1, A-5000, A-2500, A-1000, and A-500" made by Tosoh Corporation.

<Method of Measuring Acid Value of Resin>

The acid value is an amount in mg of potassium hydroxide needed to neutralize acids contained in 1 g of the sample. The acid value in the present invention is measured according to JIS K 0070-1992, and specifically according to the following procedure.

Titration is performed using a 0.1 mol/L potassium hydroxide ethyl alcohol solution (made by KISHIDA CHEMICAL Co., Ltd.). The factor of the potassium hydroxide ethyl alcohol solution can be determined using a potentiometric titrator (made by Kyoto Electronics Manufacturing Co., Ltd., a potentiometric titrator AT-510). 100 mL of 0.100 mol/L hydrochloric acid is placed in a 250 mL tall beaker, and titrated with the potassium hydroxide ethyl alcohol solution. The acid value is determined from the amount of the potassium hydroxide ethyl alcohol solution needed for neutralization. The 0.100 mol/L hydrochloric acid prepared according to JIS K 8001-1998 is used.

Below, the condition on the measurement of the acid value is shown.

Titrator: potentiometric titrator AT-510 (made by Kyoto Electronics Manufacturing Co., Ltd.)

Electrode: composite glass electrode double-junction type (made by Kyoto Electronics Manufacturing Co., Ltd.)

Control software for titrator: AT-WIN

Titration analyzing software: Tview

The titration parameters and control parameters during titration are set as follows.

Titration Parameters

Titration mode: blank titration

Titration method: total amount titration

Largest titration amount: 20 mL

Waiting time before titration: 30 seconds

Titration direction: automatic

Control Parameters

End point determining potential: 30 dE

End point determining potential value: 50 dE/dmL

Determination of end point detection: not set

Control rate mode: standard

Gain: 1

Data collecting potential: 4 mV

Data collecting titration amount: 0.1 mL

Main Test;

0.100 g of the sample to be measured is precisely weighed and placed in a 250 mL tall beaker, and 150 mL of a mixed solution of toluene/ethanol (3:1) is added. The sample is dissolved over 1 hour. Using the potentiometric titrator, the mixed solution is titrated with the potassium hydroxide ethyl alcohol solution.

Blank Test;

The same operation as above is performed in the titration except that the sample is not used (namely, only the mixed solution of toluene/ethanol (3:1) is used).

The obtained result is substituted into the following equation to calculate the acid value.

$$A=[(C-B)\times f\times 5.611]/S$$

(wherein A: acid value (mgKOH/g), B: the amount of the potassium hydroxide ethyl alcohol solution to be added (mL) in the blank test, C: the amount of the potassium hydroxide ethyl alcohol solution to be added (mL) in the main test, f: the factor of the potassium hydroxide solution, S: sample (g).)

<Method for Measuring Hydroxyl Value of Resin>

The hydroxyl value is the amount in mg of potassium hydroxide needed to neutralize acetic acid bonded to a hydroxyl group when 1 g of the sample is acetylated. The hydroxyl value in the present invention is measured according to JIS K 0070-1992, and specifically according to the following procedure.

25.0 g of super grade acetic anhydride is placed in a 100 mL volumetric flask, and pyridine is added to provide a solution having a total volume of 100 mL. The solution is sufficiently shaken to obtain an acetylation reagent. The obtained acetylation reagent is stored in a brown bottle so as to avoid contact with moisture and carbon dioxide gas.

Titration is performed using a 1.0 mol/L potassium hydroxide ethyl alcohol solution (made by KISHIDA CHEMICAL Co., Ltd.). The factor of the potassium hydroxide ethyl alcohol solution can be determined using a potentiometric titrator (made by Kyoto Electronics Manufacturing Co., Ltd., potentiometric titrator AT-510). 100 mL of a 1.00 mol/L hydrochloric acid is placed in a 250 mL tall beaker, and titrated with the potassium hydroxide solution. The hydroxyl value is determined from the amount of the potassium hydroxide ethyl alcohol solution needed for neutralization. The 1.00 mol/L hydrochloric acid prepared according to JIS K 8001-1998 is used.

Below, the condition on the measurement of the hydroxyl value is shown.

Titrator: potentiometric titrator AT-510 (made by Kyoto Electronics Manufacturing Co., Ltd.)

Electrode: composite glass electrode double-junction type (made by Kyoto Electronics Manufacturing Co., Ltd.)

Control software for titrator: AT-WIN

Titration analyzing software: Tview

The titration parameters and control parameters during titration are set as follows.

Titration Parameters

Titration mode: blank titration

Titration method: total amount titration

Largest titration amount: 80 mL

Waiting time before titration: 30 seconds

Titration direction: automatic

Control Parameters

End point determining potential: 30 dE

End point determining potential value: 50 dE/dmL

Determination of end point detection: not set

Control rate mode: standard

Gain: 1

Data collecting potential: 4 mV

Data collecting titration amount: 0.5 mL

Main Test;

2.00 g of a crushed sample to be measured is precisely weighed and placed into a 200 mL round-bottomed flask, and exactly 5.00 mL of the acetylation reagent is added to this using a transfer pipette. At this time, if the sample is difficult to dissolve in the acetylation reagent, a small amount of super grade toluene is added to dissolve the sample.

A small funnel is placed on the neck of the flask, and the bottom of the flask is dipped by 1 cm in a glycerol bath at 97° C. and heated. At this time, in order to prevent the temperature of the neck of the flask from being increased by the heat from the bath, a cardboard having a round hole is preferably disposed on the bottom of the neck of the flask.

After 1 hour, the flask is taken out from the glycerol bath, and left as it is to be cooled. After cooling, 1.00 mL of water is added with the funnel, and the solution is shaken to hydrolyze acetic anhydride. Further, in order to completely hydrolyze acetic anhydride, the flask is again heated in the glycerol bath for 10 minutes. After cooling, the funnel and the wall of the flask are washed with 5.00 mL of ethyl alcohol.

The obtained sample is poured in a 250 mL tall beaker, and 100 mL of a mixed solution of toluene/ethanol (3:1) is added to dissolve the sample over 1 hour. Using the potentiometric titrator, the sample is titrated with the potassium hydroxide ethyl alcohol solution.

Blank Test;

The same operation is performed in the titration except that the sample is not used.

The obtained result is substituted into the following equation to calculate the hydroxyl value.

$$A=[\{(B-C)\times 28.05\times f\}/S]+D$$

wherein A: hydroxyl value (mgKOH/g), B: the amount of potassium hydroxide ethyl alcohol solution to be added (mL) in the blank test, C: the amount of potassium hydroxide ethyl alcohol solution to be added (mL) in the main test, f: the factor of the potassium hydroxide solution, S: sample (g), D: acid value of the resin (mgKOH/g).

<Method for Measuring Acid Value in Surface of Toner Particle>

120 mL of ion exchange water and 30 mL of methanol are placed in a 300 mL flat-bottomed beaker made of glass, and mixed. 7.5 mL of a sodium dodecylbenzenesulfonate 1% aqueous solution as a dispersant is added to the mixed solution to prepare a dispersant solution.

While the dispersant solution in the beaker is stirred by a stirrer, 10.00 g of the toner particle is added little by little to the dispersant solution and dispersed. Further, using an ultrasonic disperser "Ultrasonic Dispension System Tetora 150" (made by Nikkaki-Bios Co., Ltd.), an ultrasonic dispersing treatment is performed for 60 seconds. In the ultrasonic dispersion, the temperature of water in the water bath is properly adjusted such that the temperature is not less than 10° C. and not more than 40° C. If the surface of the toner particle has a low acid value and the toner particles are difficult to disperse in the dispersion liquid, proper increase in the concentration of methanol in the dispersion liquid is effective.

The toner dispersion liquid is neutralized and titrated with the 1 mol/L potassium hydroxide ethyl alcohol solution (made by KISHIDA CHEMICAL Co., Ltd.). Titration is performed by the same method as that in the measurement of the acid value of the resin except that the sample solution used in the main test in the method for measuring the acid value of the resin is replaced by the toner particle dispersion liquid, and the acid value in the surface of the toner particle is calculated.

<Measurement of Content of Structure B in Polymer>

An amount of a sulfur element (ppm) contained in the polymer is measured. From the amount of the sulfur element, the content (μmol) of the structure B represented by the formula (4) in the resin can be calculated. Specifically, the polymer is introduced into an automatic sample combustion apparatus (apparatus name: ion chromatography pre-treatment apparatus AQF-100 (specification of the apparatus: Auto Boat Controller ABC, an integrated type of AQF-100 and GA-100, made by DIA Instruments Co., Ltd.), and turned into combustion gas. The gas is absorbed by an absorbent solution ($H_2O_2$, 30 ppm aqueous solution). Next, using an ion chromatography (apparatus name: Ion Chromatograph ICS2000, column: IONPAC AS17, made by Dionex Corporation), the amount of $SO_4$ contained in the absorbent solution is measured. Thereby, the amount of the sulfur element (ppm) contained in the polymer is calculated. From the obtained amount of the sulfur element (ppm) in the polymer, the content (μmol) of the structure B represented by the formula (4) in the polymer is calculated. The structure B can be identified by analysis using NMR described later.

<Measurement of Content of Structure B in Toner>

The amount of the sulfur element (ppm) contained in the toner is measured. From the amount of the sulfur element, the content (μmol) of the structure B per 1 g of the toner can be calculated. The measurement can be performed in the same manner as in the measurement of the amount of the sulfur element above.

<Calculation of Molar Ratio a/b of Structure A to Structure B in Toner>

The molar ratio a/b of the structure A to the structure B in the toner can be determined from the molar ratio a/b of the content (μmol/g) of the structure A calculated from the amount of the polymer to be used for production of the toner to the content (μmol/g) of the structure B calculated from the amount of the sulfur element in the polymer contained in the toner.

<Analysis of Structures of Polymer and Polymerizable Monomer>

The structures of the polymer having the structure B, the polymer having the structure A, and the polymerizable monomer can be determined using a nuclear magnetic resonance apparatus ($^1$H-NMR, $^{13}$C-NMR) and an FT-IR spectrum. Hereinafter, the apparatus used in the present invention will be described.

(i) $^1$H-NMR, $^{13}$C-NMR made by JEOL, Ltd., FT-NMR JNM-EX400 (solvent to be used, chloroform-dl)

(ii) FT-IR Spectrometer made by Thermo Fisher Scientific Inc. AVATAR360 FT-IR

<Method for Measuring Weight Average Particle Size (D4) and Number Average Particle Size (D1) of Toner>

The weight average particle size (D4) and the number average particle size (D1) of the toner are calculated as follows. As the measurement apparatus, an accurate particle size distribution measurement apparatus "Coulter Counter Multisizer 3" (Registered Trademark, made by Beckman Coulter, Inc.) having a 100 μm aperture tube is used, in which an aperture electric resistance method is used. The setting of the measurement condition and analysis of the measured data are performed using the dedicated software "Beckman Coulter Multisizer 3 Version 3.51" (made by Beckman Coulter, Inc.). The measurement is performed at 25,000 effective measuring channels.

An electrolytic aqueous solution that can be used for the measurement is those obtained by dissolving super grade sodium chloride in ion exchange water such that the concentration is 1% by mass, for example, "ISOTON II" (made by Beckman Coulter, Inc.).

Before the measurement and analysis are performed, the dedicated software is set as follows. In a "change standard measuring method (SOM)" screen in the dedicated software, the total count number in the control mode is set at 50000 particles, the number of measurement is set at 1, and the Kd value is set at a value obtained using a "standard particle 10.0 μm" (made by Beckman Coulter, Inc.). A "threshold/noise level measuring button" is pressed to automatically set the threshold and the noise level. The current is set at 1600 μA, and the gain is set at 2. The electrolyte solution is set at ISOTON II, and "flush aperture tube after measurement" is checked. In a "set conversion from pulse to particle size" screen in the dedicated software, the bin interval is set at a logarithmic particle size, the particle size bin is set at 256 particle size bins, and the particle size range is set from 2 μm to 60 μm.

A specific measurement method is as follows.

(1) 200 mL of the electrolytic aqueous solution is placed in a 250 mL round-bottomed glass beaker only for Multisizer 3, and set on a sample stand. The electrolytic aqueous solution is stirred by a stirring rod counterclockwise at 24 rotations/sec. Dirt and bubbles within the aperture tube are removed by a function to "flush aperture" in the dedicated software.

(2) 30 mL of the electrolytic aqueous solution is placed in a 100 mL flat-bottomed glass beaker. To the electrolytic aqueous solution, 0.3 mL of a diluted solution as a dispersant is added, the diluted solution being obtained by diluting "CONTAMINONN" (10% by mass aqueous solution of a neutral detergent for washing a precise measurement apparatus having a pH of 7 and including a nonionic surfactant, an anionic surfactant, and an organic builder, made by Wako Pure Chemical Industries, Ltd.) with ion exchange water 3 times in mass.

(3) An ultrasonic disperser "Ultrasonic Dispension System Tetora 150" (made by Nikkaki-Bios Co., Ltd.) having an electrical output of 120 W is prepared, in which two oscillators having an oscillation frequency of 50 kHz are incorporated with one phase thereof being shifted 180° from the other. 3.3 L of ion exchange water is placed in a water bath of the ultrasonic disperser, and 2 mL of CONTAMINONN is added to the water bath.

(4) The beaker in (2) is set in a beaker fixing hole of the ultrasonic disperser, and the ultrasonic disperser is operated. The vertical position of the beaker is adjusted such that the resonant state at the solution level of the electrolytic aqueous solution in the beaker is the maximum.

(5) While the electrolytic aqueous solution in the beaker of (4) is irradiated with an ultrasonic wave, 10 mg of the toner is added to the electrolytic aqueous solution little by little, and dispersed. Further, the ultrasonic dispersing treatment is continued for 60 seconds. In the ultrasonic dispersion, the temperature of water in the water bath is properly adjusted such that the temperature is not less than 10° C. and not more than 40° C.

(6) Using a pipette, the electrolyte aqueous solution sample in which the toner is dispersed in (5) is dropped in the round-bottomed beaker in (1) set in the sample stand, and adjusted such that the measurement concentration is 5%. The measurement is performed until the number of particles to be measured reaches 50000.

(7) The data of measurement is analyzed by the dedicated software attached to the apparatus, and the weight average particle size (D4) and the number average particle size (D1) are calculated. The weight average particle size (D4) is provided as the "average size" in an "analysis/volume statistical value (arithmetic average)" screen when graph/% by volume is set using the dedicated software, and the number average particle size (D1) is provided as the "average size" in an "analysis/number statistical value (arithmetic average)" screen when graph/% by number is set using the dedicated software.

EXAMPLES

Hereinafter, using Examples, the present invention will be specifically described, but the present invention will not be limited to these Examples. "Parts" mean "parts by mass."

Hereinafter, among the structures represented by the formula (1), Synthesis Examples of the polymerizable monomers will be shown in the case of the compound represented by the formula (3) and having a vinyl group.

<Synthesis Example of Compound A-1>

(Step 1)

While 100 g of 2,5-dihydroxybenzoic acid and 1441 g of 80% sulfuric acid were heated to 50° C., these were mixed. 144 g of tert-butyl alcohol was added to the mixed solution, and stirred at 50° C. for 30 minutes. Next, the operation was performed 3 times in which 144 g of tert-butyl alcohol was added to the mixed solution, and stirred at 50° C. for 30 minutes. The reaction solution was cooled to room temperature. The reaction solution was gradually poured into 1.00 kg of ice water, and a precipitate was filtered. The precipitate was washed with water, and further washed with hexane. The precipitate obtained here was dissolved in 200 mL of methanol, and again precipitated in 3.60 L of water. After filtration, the obtained product was dried at 80° C. to obtain 74.9 g of a salicylic acid intermediate product represented by the following formula (7).

Formula (7)

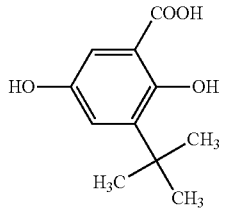

(Step 2)

25.0 g of the salicylic acid intermediate product was dissolved in 150 mL of methanol. 36.9 g of potassium carbonate was added to the solution, and the solution was heated to 65° C. A solution was prepared by mixing and dissolving 18.7 g of 4-(chloromethyl)styrene in 100 mL of methanol, and dropped into the solution having the salicylic acid intermediate product dissolved therein. A reaction was made at 65° C. for 3 hours. The obtained reaction solution was cooled, and filtered. Methanol in the filtrate was removed under reduced pressure to obtain a precipitate. The precipitate was dispersed in 1.50 L of water at pH=2. Ethyl acetate wad added, and the precipitate was extracted. Then, the precipitate was washed with water, and dried with magnesium sulfate. Ethyl acetate was removed under reduced pressure to obtain a precipitate. The precipitate was washed with hexane, and recrystallized with toluene/ethyl acetate to obtain 20.1 g of Compound A-1 having the structure below.

Compound A-1

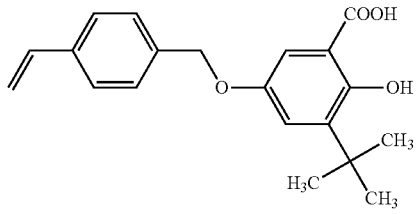

<Synthesis Example of Compound A-2>

100.0 g of 2,5-dihydroxybenzoic acid was dissolved in 2 L of methanol, 88.3 g of potassium carbonate was added, and the solution was heated to 67° C. 102.0 g of 4-(chloromethyl) styrene was dropped into the solution over 22 minutes, and a reaction was made at 67° C. for 12 hours. The obtained reaction solution was cooled, and methanol was removed under reduced pressure. The residue was washed with hexane. The residue was dissolved in methanol, and the solution was dropped into water to reprecipitate the residue. The precipitate was filtered. The reprecipitation operation was repeated twice, and the residue was dried at 80° C. to obtain Compound A-2 having the structure below.

Compound A-2

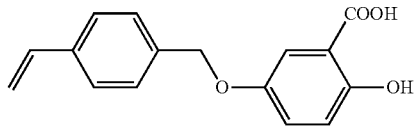

<Synthesis Example of Compound A-3>

Compound A-3 having the structure below was obtained by the same method as that in the synthesis of Compound A-1 (Step 2) except that the salicylic acid intermediate product represented by the formula (7) was replaced by 18 g of 2,6-dihydroxybenzoic acid.

Compound A-3

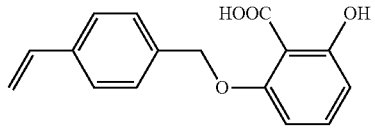

<Synthesis Example of Compound A-4>

A salicylic acid intermediate product was obtained by the same method as that in the synthesis of Compound A-1 (Step 1) except that 144 g of tert-butyl alcohol was replaced by 253 g of 2-octanol. Compound A-4 having the structure below was obtained by the same method as that in the synthesis of Compound A-1 (Step 2) except that 32 g of the salicylic acid intermediate product obtained here was used.

Compound A-4

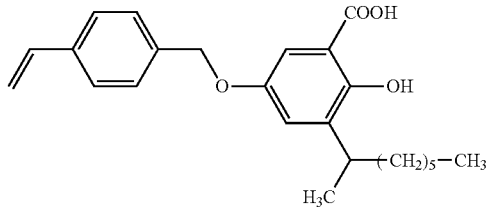

<Synthesis Example of Compound A-5>

Compound A-5 having the structure below was obtained by the same method as that in the synthesis of Compound A-1 (Step 2) except that the salicylic acid intermediate product represented by the formula (7) was replaced by 22 g of 2,5-dihydroxy-3-methoxybenzoic acid.

Compound A-5

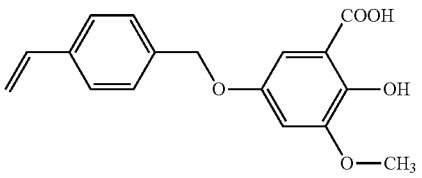

<Synthesis Example of Compound A-6>

Compound A-6 having the structure below was obtained by the same method as that in the synthesis of Compound A-1 (Step 2) except that the salicylic acid intermediate product represented by the formula (7) was replaced by 18 g of 2,4-dihydroxybenzoic acid.

Compound A-6

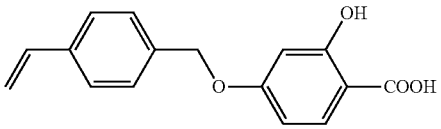

<Synthesis Example of Compound A-7>

Compound A-7 having the structure below was obtained by the same method as that in the synthesis of Compound A-1 (Step 2) except that the salicylic acid intermediate product represented by the formula (7) was replaced by 18 g of 2,3-dihydroxybenzoic acid.

Compound A-7

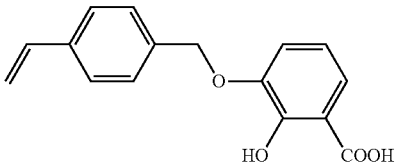

<Synthesis Example of Compound A-8>

Compound A-8 having the structure below was obtained by the same method as that in the synthesis of Compound A-1 (Step 2) except that 4-(chloromethyl)styrene was replaced by a mixture of 3-(chloromethyl)methylstyrene and 4-(chloromethyl)styrene (made by AGC SEIMI CHEMICAL CO., LTD., trade name "CMS-P").

Compound A-8

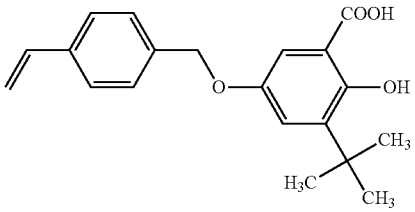

-continued

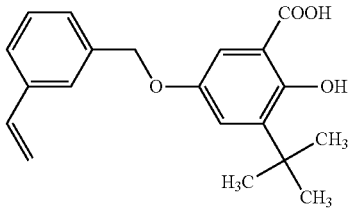

Hereinafter, Synthesis Examples of the binder resin having a polarity used as the charging component will be shown.

<Synthesis Example of Polyester PES-1>

| | |
|---|---|
| Bisphenol A propylene oxide 2.2 mol adduct | 67.8 parts |
| Terephthalic acid | 22.2 parts |
| trimellitic anhydride | 10.0 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-1.

<Synthesis Example of Polyester PES-2>

| | |
|---|---|
| Bisphenol A propylene oxide 2.2 mol adduct | 68.0 parts |
| Terephthalic acid | 28.0 parts |
| Trimellitic anhydride | 4.00 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-2.

<Synthesis Example of Polyester PES-3>

| | |
|---|---|
| Bisphenol A propylene oxide 2.2 mol adduct | 67.0 parts |
| Terephthalic acid | 18.0 parts |
| Trimellitic anhydride | 15.0 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-3.

<Synthesis Example of Polyester PES-4>

| | |
|---|---|
| Bisphenol A propylene oxide 2.2 mol adduct | 66.0 parts |
| Terephthalic acid | 9.00 parts |
| Dimethyl terephthalate | 25.0 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-4.

<Synthesis Example of Polyester PES-5>

| | |
|---|---|
| Bisphenol A propylene oxide 2.2 mol adduct | 65.0 parts |
| Terephthalic acid | 3.00 parts |
| Dimethyl terephthalate | 32.0 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-5.

<Synthesis Example of Polyester PES-6>

| | |
|---|---|
| Bisphenol A propylene oxide 2.2 mol adduct | 64.5 parts |
| Terephthalic acid | 1.50 parts |
| Dimethyl terephthalate | 34.0 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-6.

<Synthesis Example of Polyester PES-7>

| | |
|---|---|
| Bisphenol A propylene oxide 2.2 mol adduct | 66.0 parts |
| Terephthalic acid | 21.0 parts |
| Trimellitic anhydride | 13.0 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain Polyester Resin PES-7.

<Synthesis Example of Styrene-Acrylic Resin SA-1>

200 parts of xylene was placed in a reaction container having a stirrer, a capacitor, a thermometer, and a nitrogen introducing pipe attached thereto, and refluxed under a nitrogen gas flow.

| | |
|---|---|
| Styrene | 78.0 parts |
| n-Butylacrylate | 20.0 parts |
| Methacrylic acid | 2.00 parts |
| Dimethyl-2,2'-azobis(2-methylpropionate) | 5.00 parts |

These were mixed. The mixed solution was dropped into the reaction container while the mixed solution was stirred, and kept in the reaction container for 10 hours. Then, the solvent was removed by distillation. The obtained product was dried under reduced pressure at 40° C. to obtain Styrene-Acrylic Resin SA-1.

<Synthesis Example of Styrene-Acrylic Resin SA-2>

The same operation as that in the method for synthesizing Resin SA-1 was performed except that the materials below were used, and Styrene-Acrylic Resin SA-2 was obtained.

| | |
|---|---|
| Styrene | 75.0 parts |
| n-Butylacrylate | 19.0 parts |
| Methacrylic acid | 1.40 parts |
| 2-Hydroxyethylmethacrylate | 4.60 parts |
| Dimethyl-2,2'-azobis(2-methylpropionate) | 5.00 parts |

<Synthesis Example of Hybrid Resin HB-1>

| | |
|---|---|
| Bisphenol A propylene oxide 2.2 mol adduct | 69.0 parts |
| Terephthalic acid | 28.0 parts |
| Fumaric acid | 3.00 parts |
| Dibutyltin oxide | 0.005 parts |

These were placed in a four-necked flask. A thermometer, a stirring rod, a capacitor, and a nitrogen introducing pipe were attached to the flask. A reaction was made under a nitrogen atmosphere at 220° C. for 5 hours to obtain polyester resin.

200 parts of xylene was placed in a reaction container having a stirrer, a capacitor, a thermometer, and a nitrogen introducing pipe attached thereto, and refluxed under a nitrogen gas flow. 70.0 parts of the polyester resin previously prepared was placed into xylene, and dissolved.

Next, the materials were mixed.

| | |
|---|---|
| Styrene | 79.0 parts |
| n-Butylacrylate | 20.3 parts |
| Acrylic acid | 0.700 parts |
| Dimethyl-2,2'-azobis (2-methylpropionate) | 1.50 parts |

The mixed solution was dropped into the reaction container while the mixed solution was stirred, and kept in the reaction container for 10 hours. Then, the solvent was removed by distillation. The obtained product was dried under reduced pressure at 40° C. to obtain Hybrid Resin HB-1.

Physical properties of the binder resins having a polarity obtained above are shown in Table 2.

TABLE 2

| | Composition of produced resin | | | | | | | | | | |
|---|---|---|---|---|---|---|---|---|---|---|---|
| | Polyester resin component | | | | | | | | | | |
| | Polyester monomer component (mol %) | | | Vinyl resin component | | | | Physical properties of produced resin | | | |
| | Polyhydric alcohol component | Polyvalent carboxylic acid component | Content (% by mass) | Vinyl resin monomer component (mol %) Styrene | n-BA | Other | Content (% by mass) | Acid value mgKOH/g | Hydroxyl value mgKOH/g | Molecular weight Mw | Mn |
| PES-1 | BPA(PO) 49.9 | TPA/TMA 35.5/13.9 | 100 | — | — | — | — | 12.1 | 3.2 | 17100 | 6300 |

TABLE 2-continued

| | Composition of produced resin | | | | | | | Physical properties of produced resin | | | |
|---|---|---|---|---|---|---|---|---|---|---|---|
| | Polyester resin component | | | | | | | | | | |
| | Polyester monomer component (mol %) | | | Vinyl resin component | | | | | | | |
| | Polyhydric alcohol component | Polyvalent carboxylic acid component | Content (% by mass) | Vinyl resin monomer component (mol %) Styrene | n-BA | Other | Content (% by mass) | Acid value mgKOH/g | Hydroxyl value mgKOH/g | Molecular weight Mw | Mn |
| PES-2 | BPA(PO) 50.2 | TPA/TMA 44.3/5.5 | 100 | — | — | — | — | 5.3 | 12.2 | 14100 | 4800 |
| PES-3 | BPA(PO) 50.2 | TPA/TMA 28.9/20.9 | 100 | — | — | — | — | 25.0 | 2.5 | 16300 | 5600 |
| PES-4 | BPA(PO) 50.3 | TPA/DMTPA 14.7/35.0 | 100 | — | — | — | — | 4.2 | 18.7 | 12200 | 5700 |
| PES-5 | BPA(PO) 50.0 | TPA/DMTPA 4.9/45.1 | 100 | — | — | — | — | 2.0 | 22.1 | 13600 | 6000 |
| PES-6 | BPA(PO) 48.9 | TPA/TMA 33.3/17.8 | 100 | — | — | — | — | 55.2 | 1.5 | 14100 | 6300 |
| PES-7 | BPA(PO) 48.0 | TPA/TMA 30.1/21.9 | 100 | — | — | — | — | 65.9 | 0.8 | 13900 | 5900 |
| SA-1 | — | — | — | 80.7 | 16.8 | MAA 2.5 | 100 | 12.0 | — | 17900 | 8100 |
| SA-2 | — | — | — | 78.0 | 16.1 | AA/2-HEMA 2.1/3.8 | 100 | 10.0 | 19.1 | 20200 | 9600 |
| HB-1 | BPA(PO) 49.9 | TPA/FMA 43.4/6.7 | 70 | 81.9 | 17.1 | AA 1.0 | 30 | 14.6 | 13.2 | 16500 | 10400 |

Hereinafter, Synthesis Examples of the polymer having the structure B will be shown.

<Monomer Represented by Formula (8) and Having Structure B>

As the monomer having the structure B, 2-acrylamide-2-methylpropanesulfonic acid represented by the formula (8) was used.

Formula (8)

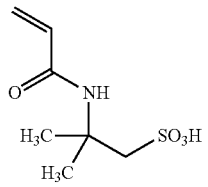

<Synthesis Example of Monomer 9 Represented by Formula (9) and Having Structure B>

1500 g of 2-acrylamide-2-methylpropanesulfonic acid, 2060 g of trimethyl orthoformate, and 1.50 g of p-benzoquinone were placed in a reaction container having a stirrer, a capacitor, a thermometer, and a nitrogen introducing pipe attached thereto, and a reaction was made at 80° C. for 5 hours. The reaction mixture was cooled, and condensed under reduced pressure. The precipitated crystals were filtered out, added to 5 L of water, and dispersed to be washed. The crystals were filtered, and washed with 2.5 L of water twice. The obtained crystals were dried at 30° C. with a fair wind, dispersed to be washed with 4 L of hexane, and filtered out. The obtained crystals were dried under reduced pressure at 30° C. to obtain 1063 g of methyl 2-acrylamide-2-methylpropanesulfonate represented by the formula (9).

Formula (9)

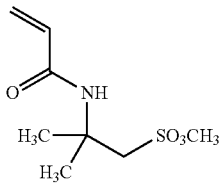

<Synthesis Example of Monomer Represented by Formula (10) and Having Structure B>

788 g of 2-amino-5-methoxybenzenesulfonic acid, 642 g of triethylamine, and 4 L of tetrahydrofuran were placed in a reaction container having a stirrer, a thermometer, and a nitrogen introducing pipe attached thereto, and 352 g of methacrylic chloride was dropped at a temperature of not more than 5° C. over 15 minutes. While the temperature was kept at not more than 5° C., the solution was stirred for 6 hours. While the temperature was kept at not more than 5° C., 800 mL of concentrated sulfuric acid and 12.8 L of water were added to the reaction mixture. The solution was separated. The organic layer was washed with 6.4 L of 2% hydrochloric acid, and then, washed with 6.4 L of water 3 times. The obtained solution was condensed under reduced pressure to obtain crystals. The obtained crystals were placed in a reaction container having a stirrer, a capacitor, a thermometer, and a nitrogen introducing pipe attached thereto. Further, 1680 g of trimethyl orthoformate and 1.50 g of p-benzoquinone were placed in the reaction container to make a reaction at 80° C. for 10 hours. The reaction mixture was cooled, and condensed under reduced pressure. The precipitated crystals were filtered out, added to 5 L of water, and dispersed to be washed. The crystals were filtered, and washed with 2.5 L of water twice. The obtained crystals were dried at 30° C. with a fair wind, and refined by column chromatography (5 kg of silica gel, mobile phase hexane/ethyl acetate=1/1) to obtain 383 g of methyl 2-acrylamide-5-methoxybenzenesulfonate represented by the formula (10).

Formula (10)

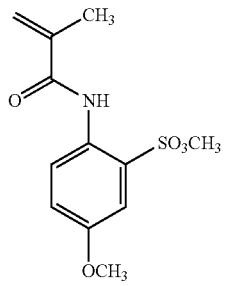

<Synthesis Example of Polymer B-1>

200 parts of xylene was placed in a reaction container having a stirrer, a capacitor, a thermometer, and a nitrogen introducing pipe attached thereto, and refluxed under a nitrogen gas flow.

| | |
|---|---|
| 2-Acrylamide-2-methylpropanesulfonic acid | 6.00 parts |
| Styrene | 78.0 parts |
| 2-Ethylhexylacrylate | 16.0 parts |
| Dimethyl-2,2'-azobis (2-methylpropionate) | 5.00 parts |

These were mixed. The mixed solution was dropped into the reaction container while the mixed solution was stirred, and kept in the reaction container for 10 hours. Then, the solvent was removed by distillation. The obtained product was dried under reduced pressure at 40° C. to obtain Polymer B-1. The measurement of the amount of the sulfur element showed that the obtained Polymer B-1 contains 263 μmol/g of the unit derived from sulfonic acid.

<Synthesis Example of Polymer B-2>

Polymer B-2 was synthesized in the same manner as in synthesis of Polymer B-1 except that the materials below were used, and Polymer B-2 was obtained.

| | |
|---|---|
| Methyl 2-acrylamide-2-methylpropanesulfonate | 12.0 parts |
| Styrene | 72.0 parts |
| 2-Ethylhexylacrylate | 16.0 parts |
| Dimethyl-2,2'-azobis (2-methylpropionate) | 5.00 parts |

The measurement of the amount of the sulfur element showed that the obtained Polymer B-2 contains 521 μmol/g of the unit derived from sulfonic acid.

<Synthesis Example of Polymer B-3>

Polymer B-3 was synthesized in the same manner as in synthesis of Polymer B-1 except that the materials below were used, and Polymer B-3 was obtained.

| | |
|---|---|
| Methyl 2-acrylamide-5-methoxybenzenesulfonate | 16.0 parts |
| Styrene | 74.0 parts |
| n-Butylacrylate | 10.0 parts |
| Dimethyl-2,2'-azobis (2-methylpropionate) | 5.00 parts |

The measurement of the amount of the sulfur element showed that the obtained Polymer B-3 contains 539 μmol/g of the unit derived from sulfonic acid. Physical properties of the polymers having the structure B and obtained above are shown in Table 3.

TABLE 3

| | Physical properties of produced resin | | | |
|---|---|---|---|---|
| | Amount of S in polymer | Content of structure B in polymer | Molecular weight | |
| | % by mass | μmol/g | Mw | Mn |
| Polymer B-1 | 0.84 | 263 | 18500 | 7100 |
| Polymer B-2 | 1.67 | 521 | 14900 | 6900 |
| Polymer B-3 | 1.73 | 539 | 12300 | 6600 |

Example 1

Production of Pigment Dispersed Paste

| | |
|---|---|
| Styrene | 80.0 parts |
| C.I. Pigment Blue 15:3 | 14.0 parts |

The materials above were sufficiently premixed in a container. The premix was dispersed by a bead mill for 5 hours while the temperature was kept at not more than 20° C., to produce a pigment dispersed paste.

Production of Toner Particles:

390 parts of a 0.1 mol/L-$Na_3PO_4$ aqueous solution was placed in 1150 parts of ion exchange water, and the solution was heated to 60° C. Using a Cleamix (made by M Technique Co., Ltd.), the solution was stirred at 11000 rpm. 58 parts of a 1.0 mol/L-$CaCl_2$ aqueous solution was added to the solution to obtain a dispersion liquid containing $Ca_3(PO_4)_2$.

| | |
|---|---|
| pigment dispersed paste above | 38.0 parts |
| Styrene | 34.0 parts |
| n-Butylacrylate | 15.0 parts |
| Paraffin wax (HNP-7: made by NIPPON SEIRO CO., LTD.) | 8.00 parts |
| Polyester PES-1 | 5.00 parts |
| Compound A-1 | 0.400 parts |
| Polymer B-1 | 0.600 parts |

The materials were placed in a container, heated to 60° C., molten, and dispersed to prepare a monomer mixture. Further, while the temperature was kept at 60° C., 5.00 parts of 2,2-azobis(2,4-dimethylvaleronitrile) as a polymerization initiator was added and dissolved to prepare a monomer composition.

The monomer composition was added to the dispersion medium. Using a Cleamix, stirring was performed at 60° C. in a nitrogen atmosphere at 10000 rpm for 20 minutes to granulate the monomer composition. Then, while stirring was performed with a paddle stirring blade, a reaction was made at 60° C. for 5 hours. Further, stirring was performed at 80° C. for 5 hours to complete polymerization. The obtained product was cooled to room temperature. Then, hydrochloric acid was added to the product to dissolve $Ca_3(PO_4)_2$, followed by filtration, washing with water, and drying. Thereby, toner particles were obtained. Further, the toner particles were classified to sort particles having a particle size of not less than 2 μm and less than 10 μm. Thus, Toner Particles 1 were obtained.

1.00 part of hydrophobic silica fine powder having a BET of 200 $m^2/g$ was externally added to 100 parts of the toner particles by a Henschel mixer to obtain Toner 1. Physical properties of the obtained toner are shown in Table 4. Moreover, the toner was evaluated as follows. The result of evaluation is shown in Table 5.

<Evaluation of Amount of Toner to be Charged>

A two-component developer was produced as follows.

For evaluation of the charging amount, a sample was prepared as follows. 276 g of a magnetic carrier F813-300 (made by Powdertech Co., Ltd.) and 24.0 g of the toner to be evaluated were placed in a plastic bottle with a cap, and shaken by a shaker (YS-LD: made by YAYOI CO., LTD.) for 1 minute at a rate of 4 reciprocating motions per 1 second. Thereby, a two-component developer was prepared.

The obtained toner and two-component developer were evaluated as follows.

<Evaluation of Amount of Toner to be Charged Under High Temperature and High Humidity>

The charging amount was measured as follows: 30.0 g of the two-component developer was taken, and left under a high temperature and high humidity environment (30° C./80%) three days and three nights. Then, the two-component developer was placed in a 50 cc plastic container, and shaken 500 times at a rate of 200 times/min. Using an apparatus in FIG. 1, the charging amount was measured. The absolute value of the measured charging amount was determined according to the following criterion and evaluated.

A rank: not less than 40.0 mC/kg
B rank: not less than 30.0 mC/kg and less than 40.0 mC/kg
C rank: not less than 20.0 mC/kg and less than 30.0 mC/kg
D rank: not less than 10.0 mC/kg and less than 20.0 mC/kg
E rank: less than 10.0 mC/kg (Method for Measuring Charging Amount)

0.500 g of the two-component developer to be measured for the frictional charging amount is placed in a metallic measuring container 2 having a 500 mesh (opening of 25 μm) screen 3 in the bottom, which is illustrated in FIG. 1. Then, the measuring container 2 is covered with a metallic cover 4. The mass of the entire measuring container 2 at this time is a weight Wl (g). Next, in a suction apparatus 1 (a portion contacting the measuring container 2 is at least an insulating body), the toner is sucked from a suction port 7, and a wind amount control valve 6 is adjusted to provide a pressure of 250 mmAq in a vacuum gauge 5. In this state, the toner is sucked sufficiently and preferably for 2 minutes, and removed by sucking.

The potential in the electrometer 9 at this time is V (volt). Here, a capacitor 8 is illustrated, and the capacitance is C(μF). The mass of the entire measuring container after suction is a weight W2 (g). The frictional charging amount (mC/kg) of the toner is calculated by the equation below.

$$\text{Frictional charging amount(mC/kg)}=(C\times V)/(W1-W2)$$

<Evaluation of Environmental Dependency of Amount of Toner to be Charged>

The amount of the toner to be charged was measured in the same manner as that in the method for evaluating the amount of the toner to be charged under a high temperature and high humidity except that the environment in which the developer was left was a low temperature and low humidity (15° C./15%). The absolute value of the ratio of the charging amount under a low temperature and low humidity to the charging amount under a high temperature and high humidity (charging amount under a low temperature and low humidity/charging amount under a high temperature and high humidity) was calculated, and the environmental dependency of the amount of the toner to be charged was determined according to the following criterion and evaluated.

A rank: less than 1.30
B rank: not less than 1.30 and less than 1.50
C rank: not less than 1.50 and less than 2.00
D rank: not less than 2.00

<Evaluation of Rise Property of Amount of Toner to be Charged>

270 g of the two-component developer was taken, and left under a high temperature and high humidity environment (30° C./80% RH) three days and three nights. The two-component developer was mounted on a developing apparatus in a color laser copier CLC5500 (made by Canon Inc.). The color laser copier was idly rotated at 240 rpm using an idling apparatus including an external motor. The two-component developer on the developing sleeve was taken when rotation was performed for 1 minute (Q1 min), when the rotation was performed for another 1 minute (namely, rotation for 2 minutes in total) (Q2 min), and when rotation was further performed for 3 minutes (namely, rotation for 5 minutes in total) (Q5 min), and the charging amounts of the respective two-component developers were measured by the apparatus in FIG. 1. (Q5 min/Q1 min) and (Q5 min/Q2 min) were calculated, and the rise property was determined according to the following criterion and evaluated.

A rank: less than 1.20
B rank: not less than 1.20 and less than 1.40
C rank: not less than 1.40 and less than 1.60
D rank: not less than 1.60 and less than 1.80
E rank: not less than 1.80

Examples 2 to 24

A toner was produced in the same manner as in Example 1 except that the formula in Example 1 was replaced by the formulas shown in Table 4. Thus, Toners 2 to 24 were obtained. Physical properties of the obtained toners are shown in Table 4. Evaluation was performed in the same manner as in Example 1, and the results are shown in Table 5.

Example 25

Production of Pigment Dispersed Paste

| | |
|---|---|
| Styrene | 80.0 parts |
| Carbon black | 14.0 parts |

The materials were sufficiently premixed in a container. While the temperature was kept at not more than 20° C., the premix was dispersed by a bead mill for 4 hours to obtain a pigment dispersed paste.

Production of Toner Particles 350 parts of a 0.1 mol/L-$Na_3PO_4$ aqueous solution was placed in 1200 parts of ion exchange water, and the solution was heated to 60° C. Then, using a Cleamix (made by M Technique Co., Ltd.), the solution was stirred at 11,000 rpm. 52 parts of a 1.0 mol/L-$CaCl_2$ aqueous solution was added to the solution to obtain a dispersion medium containing $Ca_3(PO_4)_4$.

| | |
|---|---|
| Pigment dispersed paste above | 38.0 parts |
| Styrene | 30.0 parts |
| n-Butylacrylate | 17.0 parts |
| Ester wax | 10.0 parts |

-continued

| | |
|---|---|
| (principal component $C_{19}H_{39}COOC_{20}H_{41}$, melting point of 68.6° C.) | |
| Polyester PES-1 | 5.00 parts |
| Compound A-1 | 0.400 parts |
| Polymer B-1 above | 0.600 parts |

The materials were placed in a container, heated to 60° C., and dissolved and dispersed to prepare a monomer mixture. Further, while the temperature was kept at 60° C., 5.00 parts of 2,2'-azobis(2,4-dimethylvaleronitrile) as a polymerization initiator was added and dissolved to obtain a monomer composition. A toner was produced in the same manner as in Example 1 except that the dispersion medium and the monomer composition were used, to obtain Toner 25. Physical properties of the obtained toner are shown in Table 4. Evaluation was performed in the same manner as in Example 1, and the results are shown in Table 5.

Example 26

A toner was produced in the same manner as in Example 1 except that the colorant in Example 1, i.e., C.I. Pigment Blue 15:3 was replaced by 14.0 parts of quinacridone (Pigment Violet 19). Thus, Toner 26 was obtained. Physical properties of the obtained toner are shown in Table 4. Evaluation was performed in the same manner as in Example 1, and the results are shown in Table 5.

Example 27

Production of Pigment Dispersed Paste

| | |
|---|---|
| Styrene | 80.0 parts |
| C.I. Pigment Blue 15:3 | 14.0 parts |

The materials were sufficiently premixed in a container. While the temperature was kept at not more than 20° C., the premix was dispersed by a bead mill for 5 hours to obtain a pigment dispersed paste.

Production of Toner Particles:

390 parts of a 0.1 mol/L-$Na_3PO_4$ aqueous solution was placed in 1150 parts of ion exchange water, and the solution was heated to 60° C. Then, using a Cleamix (made by M Technique Co., Ltd.), the solution was stirred at 11,000 rpm. 58 parts of a 1.0 mol/L-$CaCl_2$ aqueous solution was added to the solution to obtain a dispersion liquid containing $Ca_3(PO_4)_4$.

| | |
|---|---|
| Pigment dispersed paste above | 38.0 parts |
| Styrene | 34.0 parts |
| n-Butylacrylate | 15.0 parts |
| Paraffin wax (HNP-7: made by NIPPON SEIRO CO., LTD.) | 8.00 parts |
| Polyester PES-1 | 5.00 parts |

These were heated to 60° C., and dissolved and dispersed to prepare a monomer mixture. Further, while the temperature was kept at 60° C., 5.00 parts of 2,2'-azobis(2,4-dimethylvaleronitrile) as a polymerization initiator was added and dissolved to obtain a monomer composition.

The monomer composition was added in the dispersion medium. Using a Cleamix, stirring was performed at 60° C. in a nitrogen atmosphere at 10000 rpm for 20 minutes to granulate the monomer composition. Then, while stirring was performed with a paddle stirring blade, a reaction was made at 60° C. for 1 hour to obtain core particles.

| | |
|---|---|
| Styrene | 7.50 parts |
| n-Butylacrylate | 2.50 parts |
| Compound A-1 | 0.500 parts |

The materials were placed in a container, heated to 60° C., molten, and dispersed to prepare a monomer mixture. Further, while the temperature was kept at 60° C., 0.500 parts of 2,2'-azobis(2,4-dimethylvaleronitrile) as a polymerization initiator was added and dissolved to prepare a monomer composition for seed polymerization.

The monomer composition was added to the dispersion medium to perform the seed polymerization. Then, while the mixture was stirred by a paddle stirring blade, a reaction was made at 60° C. for 5 hours. Next, the mixture was stirred at 80° C. for 5 hours to complete the polymerization. The obtained product was cooled to room temperature. Then, hydrochloric acid was added to the product to dissolve $Ca_3(PO_4)_2$, followed by filtration, washing with water, and drying. Thereby, toner particles were obtained. Further, the toner particles were classified to sort particles having a particle size of not less than 2 μm and less than 10 μm. Thus, Toner Particles 27 were obtained. Further, in the same manner as in Example 1, hydrophobic silica fine powder was externally added to Toner Particles 27 to obtain Toner 27. Physical properties of the obtained toner are shown in Table 4. Moreover, the obtained toner was evaluated in the same manner as in Example 1, and the result is shown in Table 5.

Example 28

Production of Toner Particles

| | |
|---|---|
| Hybrid Resin HB-1 | 100.0 parts |
| Carbon black | 5.00 parts |
| Paraffin wax (HNP-7: made by NIPPON SEIRO CO., LTD.) | 3.00 parts |

The toner materials were sufficiently premixed by a Henschel mixer (made by Mitsui Mining Co., Ltd.), and molten kneaded by a twin screw extruder. After cooling, the obtained product was crushed using a hammer mill to have a particle size of approximately 1 to 2 mm. Next, the product was pulverized by an air jet pulverizer. Further, the obtained pulverized product was classified by a multiclassifier to obtain core particles having a weight average particle size of 6.5 μm.

Next, 709 parts of ion exchange water and 451 parts of a 0.1M-$NaPO_4$ aqueous solution were placed in a flask, and the solution was heated to 60° C. Then, 67.7 parts of a 1.0 M-$CaCl_2$ aqueous solution was added to obtain an aqueous medium containing $Ca_3(PO_4)_2$.

Next, 390 parts of a 0.1 mol/L-$Na_3PO_4$ aqueous solution was added to 1150 parts of ion exchange water, and the solution was heated to 60° C. Then, using a Cleamix (made by M Technique Co., Ltd.), the solution was stirred at 11,000 rpm. 58 parts of a 1.0 mol/L-$CaCl_2$ aqueous solution was added to the solution to obtain a dispersion liquid containing $Ca_3(PO_4)_2$.

The core particles were added to the aqueous medium such that the solid content was 30%, and the solution was stirred at 60° C. under an $N_2$ atmosphere by a high speed stirrer to primarily disperse the core particles. Part of the core particle dispersion liquid was sampled, and it was checked that the weight average particle size was 6.5 μm. While the core particle dispersion liquid was stirred by a paddle stirring blade, the core particle dispersion liquid was heated to 80° C.

| | |
|---|---|
| Styrene | 7.50 parts |
| n-Butylacrylate | 2.50 parts |
| Compound A-2 | 0.500 parts |

These were heated to 60° C., molten, and dispersed to prepare a monomer mixture. Further, while the temperature was kept at 60° C., 0.500 parts of 2,2'-azobis(2,4-dimethylvaleronitrile) as a polymerization initiator was added and dissolved to prepare a monomer composition for seed polymerization.

The monomer composition was added to the dispersion medium to perform the seed polymerization. Then, while the mixture was stirred by a paddle stirring blade, a reaction was made at 60° C. for 5 hours. Next, the mixture was stirred at 80° C. for 5 hours to complete the polymerization. The obtained product was cooled to room temperature. Then, hydrochloric acid was added to the product to dissolve $Ca_3(PO_4)_2$, followed by filtration, washing with water, and drying. Thereby, toner particles were obtained. Further, the toner particles were classified to sort particles having a particle size of not less than 2 μm and less than 10 μm. Thus, Toner Particles 28 were obtained. Further, in the same manner as in Example 1, hydrophobic silica fine powder was externally added to Toner Particles 28 to obtain Toner 28. Physical properties of the obtained toner are shown in Table 4. Moreover, the obtained toner was evaluated in the same manner as in Example 1, and the result is shown in Table 5.

Comparative Example 1

A toner was produced in the same manner as in Example 1 except that Compound A-1 and Polymer B-1 in Example 1 were not used. Thus, Toner 29 according to Comparative Example was obtained. Physical properties of the obtained toner are shown in Table 4. Moreover, the obtained toner was evaluated in the same manner as in Example 1, and the result is shown in Table 5.

Comparative Example 2

A toner was produced in the same manner as in Example 1 except that Compound A-1 in Example 1 was not used, to obtain Toner 30 according to Comparative Example. Physical properties of the obtained toner are shown in Table 4. Moreover, the obtained toner was evaluated in the same manner as in Example 1, and the result is shown in Table 5.

Comparative Example 3

A toner was produced in the same manner as in Example 28 except that Compound A-2 in Example 28 was not used. Thus, Toner 31 according to Comparative Example was obtained. Physical properties of the obtained toner are shown in Table 4. Moreover, the obtained toner was evaluated in the same manner as in Example 1, and the result is shown in Table 5.

Comparative Example 4

A toner was produced in the same manner as in Example 1 except that Polyester PES-1 and Polymer B-1 in Example 1 were not used. Thus, Toner 32 according to Comparative Example was obtained. Physical properties of the obtained toner are shown in Table 4. Moreover, the obtained toner was evaluated in the same manner as in Example 1, and the result is shown in Table 5.

Comparative Example 5

A toner was produced in the same manner as in Example 1 except that Compound A-1 in Example 1 was not used, 0.400 parts of a benzilic acid boron compound LR-147 (made by Japan Carlit Co., Ltd.) was used, and Polymer B-1 was not used. Thereby, Toner 33 according to Comparative Example was obtained. Physical properties of the obtained toner are shown in Table 4. Moreover, the obtained toner was evaluated in the same manner as in Example 1, and the result is shown in Table 5.

TABLE 4

| | | Outline of toner | | | | | | | | |
|---|---|---|---|---|---|---|---|---|---|---|
| | | | | | | Resin having polarity as charging component | | | Polymer having structure B in toner | |
| | | Polymer having structure A in toner | | | | Acid | | | | |
| | | Monomer | Amount to be added Parts | Structure in polymer | Content a μmol/g | Polar resin | value of resin mgKO | Amount to be added Parts | Polymer | Amount to be added Parts |
| Example 1 | Toner 1 | Compound A-1 | 0.400 | 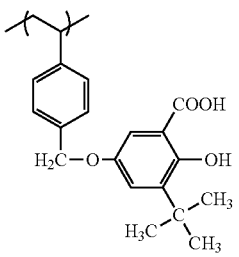 | 12.1 | PES-1 | 12.1 | 5.0 | Polymer B-1 | 0.600 |

TABLE 4-continued
| | | | | | | | | | | |
|---|---|---|---|---|---|---|---|---|---|---|
| Example 2 | Toner 2 | Compound A-2 | 0.400 | 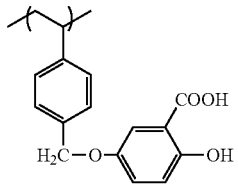 | 14.7 | PES-1 | 12.1 | 5.0 | Polymer B-1 | 0.600 |
| Example 3 | Toner 3 | Compound A-3 | 0.400 | 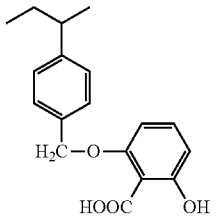 | 14.7 | PES-1 | 12.1 | 5.0 | Polymer B-1 | 0.200 |
| Example 4 | Toner 4 | Compound A-3 | 5.00 | Same as Example 3 | 14.7 | PES-2 | 5.3 | 5.0 | Polymer B-1 | 0.600 |
| Example 5 | Toner 5 | Compound A-4 | 0.400 | 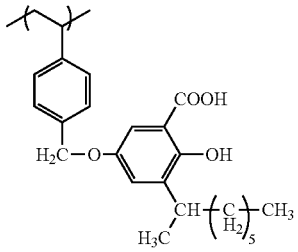 | 10.3 | SA-1 | 12.0 | 5.0 | Polymer B-1 | 1.20 |
| Example 6 | Toner 6 | Compound A-5 | 0.400 | 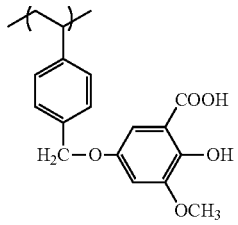 | 13.2 | SA-2 | 10.0 | 5.0 | Polymer B-1 | 1.80 |
| Example 7 | Toner 7 | Compound A-6 | 0.400 | 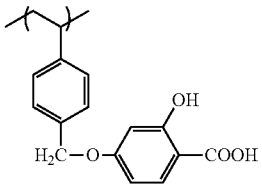 | 14.7 | PES-3 | 25.0 | 5.0 | Polymer B-1 | 0.600 |
| Example 8 | Toner 8 | Compound A-7 | 0.400 | 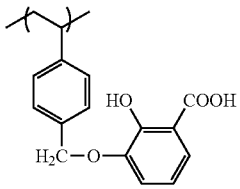 | 14.7 | PES-3 | 25.0 | 5.0 | Polymer B-1 | 0.600 |

TABLE 4-continued

| | | | | | | | | | | |
|---|---|---|---|---|---|---|---|---|---|---|
| Example 9 | Toner 9 | Compound A-8 | 0.400 | 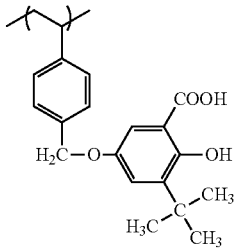 and 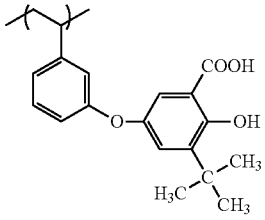 | 12.1 | PES-4 | 4.2 | 5.0 | Polymer B-1 | 0.600 |
| Example 10 | Toner 10 | Compound A-1 | 0.400 | Same as Example 1 | 12.1 | PES-5 | 2.0 | 5.0 | Polymer B-1 | 0.600 |
| Example 11 | Toner 11 | Compound A-1 | 0.400 | Same as Example 1 | 12.1 | PES-6 | 55.2 | 5.0 | Polymer B-1 | 0.600 |
| Example 12 | Toner 12 | Compound A-1 | 0.400 | Same as Example 1 | 12.1 | PES-7 | 65.9 | 5.0 | Polymer B-1 | 0.600 |
| Example 13 | Toner 13 | Compound A-1 | 0.005 | Same as Example 1 | 0.15 | PES-1 | 12.1 | 5.0 | Polymer B-3 | 0.200 |
| Example 14 | Toner 14 | Compound A-1 | 0.005 | Same as Example 1 | 0.15 | PES-1 | 12.1 | 5.0 | Polymer B-3 | 0.600 |
| Example 15 | Toner 15 | Compound A-1 | 0.200 | Same as Example 1 | 6.1 | PES-1 | 12.1 | 5.0 | Polymer B-3 | 0.600 |
| Example 16 | Toner 16 | Compound A-1 | 0.800 | Same as Example 1 | 24.2 | PES-1 | 12.1 | 5.0 | Polymer B-3 | 0.600 |
| Example 17 | Toner 17 | Compound A-2 | 1.60 | Same as Example 2 | 57.9 | PES-1 | 12.1 | 5.0 | Polymer B-2 | 0.600 |
| Example 18 | Toner 18 | Compound A-2 | 5.60 | Same as Example 2 | 195 | PES-1 | 12.1 | 5.0 | Polymer B-2 | 0.800 |
| Example 19 | Toner 19 | Compound A-2 | 5.60 | Same as Example 2 | 195 | PES-1 | 12.1 | 5.0 | Polymer B-2 | 0.600 |
| Example 20 | Toner 20 | Compound A-2 | 7.20 | Same as Example 2 | 247 | PES-1 | 12.1 | 5.0 | Polymer B-2 | 0.600 |
| Example 21 | Toner 21 | Compound A-1 | 0.005 | Same as Example 1 | 0.15 | PES-1 | 12.1 | 5.0 | — | — |
| Example 22 | Toner 22 | Compound A-1 | 0.400 | Same as Example 1 | 12.2 | PES-1 | 12.1 | 5.0 | — | — |
| Example 23 | Toner 23 | Compound A-1 | 4.00 | Same as Example 1 | 118 | PES-5 | 2.0 | 5.0 | — | — |
| Example 24 | Toner 24 | Compound A-1 | 10.0 | Same as Example 1 | 279 | PES-5 | 2.0 | 5.0 | — | — |
| Example 25 | Toner 25 | Compound A-1 | 0.400 | Same as Example 1 | 12.1 | PES-1 | 12.1 | 5.0 | Polymer B-1 | 0.600 |
| Example 26 | Toner 26 | Compound A-1 | 0.400 | Same as Example 1 | 12.1 | PES-1 | 12.1 | 5.0 | Polymer B-1 | 0.600 |

TABLE 4-continued

| | | | | | | | | | | |
|---|---|---|---|---|---|---|---|---|---|---|
| Example 27 | Toner 27 | Compound A-1 | (0.500) | Same as Example 1 | 13.9 | PES-1 | 12.1 | 5.0 | — | — |
| Example 28 | Toner 28 | Compound A-2 | (0.500) | Same as Example 1 | 12.9 | HB-1 | 14.6 | *1 | — | — |
| Comparative Example 1 | Toner 29 | — | — | — | 0 | PES-1 | 12.1 | 5.0 | — | — |
| Comparative Example 2 | Toner 30 | — | — | — | 0 | PES-1 | 12.1 | 5.0 | Polymer B-1 | 0.600 |
| Comparative Example 3 | Toner 31 | — | — | — | 0 | HB-1 | 14.6 | *1 | — | — |
| Comparative Example 4 | Toner 32 | Compound A-1 | 0.400 | Same as Example 1 | 12.2 | — | — | — | — | — |
| Comparative Example 5 | Toner 33 | | | LR-147 is used as charge control agent | | PES-1 | 12.1 | — | — | — |

| | | Outline of toner | | | | | | |
|---|---|---|---|---|---|---|---|---|
| | | Polymer having structure B in toner | | Ratio of structure A to | | | Acid value in surface | Toner |
| | | Structure in polymer | Content b μmol/g | structure B a/b | Method of producing toner | Colorant | of toner particle mgKOH | particle size μm |
| Example 1 | Toner 1 | 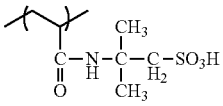 | 1.56 | 7.77 | Suspension polymerization | C.I.Pig.Blue 15:3 | 0.125 | 6.7 |
| Example 2 | Toner 2 | Same as Example 1 | 1.56 | 9.38 | Suspension polymerization | C.I.Pig.Blue 15:3 | 0.132 | 6.7 |
| Example 3 | Toner 3 | Same as Example 1 | 0.52 | 28.1 | Suspension polymerization | C.I.Pig.Blue 15:3 | 0.135 | 6.7 |
| Example 4 | Toner 4 | Same as Example 1 | 1.56 | 9.38 | Suspension polymerization | C.I.Pig.Blue 15:3 | 0.065 | 6.8 |
| Example 5 | Toner 5 | Same as Example 1 | 3.11 | 3.33 | Suspension polymerization | C.I.Pig.Blue 15:3 | 0.120 | 6.7 |
| Example 6 | Toner 6 | Same as Example 1 | 4.63 | 2.85 | Suspension polymerization | C.I.Pig.Blue 15:3 | 0.100 | 6.8 |
| Example 7 | Toner 7 | Same as Example 1 | 1.56 | 9.38 | Suspension polymerization | C.I.Pig.Blue 15:3 | 0.180 | 6.9 |
| Example 8 | Toner 8 | Same as Example 1 | 1.56 | 9.38 | Suspension polymerization | C.I.Pig.Blue 15:3 | 0.178 | 6.8 |
| Example 9 | Toner 9 | Same as Example 1 | 1.56 | 7.77 | Suspension polymerization | C.I.Pig.Blue 15:3 | 0.051 | 6.8 |
| Example 10 | Toner 10 | Same as Example 1 | 1.56 | 7.77 | Suspension polymerization | C.I.Pig.Blue 15:3 | 0.031 | 6.9 |
| Example 11 | Toner 11 | Same as Example 1 | 1.56 | 7.77 | Suspension polymerization | C.I.Pig.Blue 15:3 | 0.371 | 6.8 |
| Example 12 | Toner 12 | Same as Example 1 | 1.56 | 7.77 | Suspension polymerization | C.I.Pig.Blue 15:3 | 0.451 | 6.8 |
| Example 13 | Toner 13 | 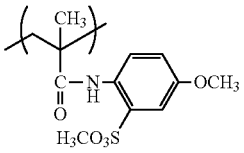 | 1.08 | 0.14 | Suspenion polymerization | C.I.Pig.Blue 15:3 | 0.120 | 6.9 |

TABLE 4-continued

| | | | | | | | | |
|---|---|---|---|---|---|---|---|---|
| Example 14 | Toner 14 | Same as Example 13 | 3.21 | 0.047 | Suspension polymerization | C.I.Pig.Blue 15:3 | 0.128 | 6.9 |
| Example 15 | Toner 15 | Same as Example 13 | 3.21 | 1.89 | Suspension polymerization | C.I.Pig.Blue 15:3 | 0.121 | 6.9 |
| Example 16 | Toner 16 | Same as Example 13 | 3.19 | 7.58 | Suspension polymerization | C.I.Pig.Blue 15:3 | 0.131 | 6.8 |
| Example 17 | Toner 17 | 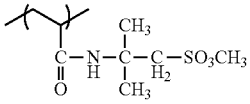 | 3.06 | 18.9 | Suspension polymerization | C.I.Pig.Blue 15:3 | 0.125 | 6.7 |
| Example 18 | Toner 18 | Same as Example 17 | 3.92 | 49.7 | Suspension polymerization | C.I.Pig.Blue 15:3 | 0.132 | 6.7 |
| Example 19 | Toner 19 | Same as Example 17 | 2.94 | 66.3 | Suspension polymerization | C.I.Pig.Blue 15:3 | 0.135 | 6.8 |
| Example 20 | Toner 20 | Same as Example 17 | 2.90 | 85.2 | Suspension polymerization | C.I.Pig.Blue 15:3 | 0.140 | 6.7 |
| Example 21 | Toner 21 | — | — | — | Suspension polymerization | C.I.Pig.Blue 15:3 | 0.121 | 6.8 |
| Example 22 | Toner 22 | — | — | — | Suspension polymerization | C.I.Pig.Blue 15:3 | 0.119 | 6.8 |
| Example 23 | Toner 23 | — | — | — | Suspension polymerization | C.I.Pig.Blue 15:3 | 0.035 | 6.8 |
| Example 24 | Toner 24 | — | — | — | Suspension polymerization | C.I.Pig.Blue 15:3 | 0.036 | 6.8 |
| Example 25 | Toner 25 | Same as Example 1 | 1.56 | 7.77 | Suspension polymerization | CB | 0.121 | 6.8 |
| Example 26 | Toner 26 | Same as Example 1 | 1.56 | 7.77 | Suspension polymerization | C.I.Pig. Violet 19 | 0.124 | 6.9 |
| Example 27 | Toner 27 | — | — | — | Seed polymerization | C.I.Pig.Blue 15:3 | 0.120 | 7.1 |
| Example 28 | Toner 28 | — | — | — | Seed polymerization | CB | 0.122 | 7.0 |
| Comparative Example 1 | Toner 29 | — | — | — | Suspension polymerization | C.I.Pig.Blue 15:3 | 0.122 | 6.8 |
| Comparative Example 2 | Toner 30 | Same as Example 1 | 1.57 | — | Suspension polymerization | C.I.Pig.Blue 15:3 | 0.124 | 6.7 |
| Comparative Example 3 | Toner 31 | — | — | — | Seed polymerization | CB | 0.143 | 7.0 |
| Comparative Example 4 | Toner 32 | — | — | — | Suspension polymerization | C.I.Pig.Blue 15:3 | 0.008 | 6.8 |
| Comparative Example 5 | Toner 33 | — | — | — | Suspension polymerization | C.I.Pig.Blue 15:3 | 0.123 | 6.9 |

*1: HB-1 is used as main binder resin

TABLE 5

| | | Result of evaluation | | | | | | | |
|---|---|---|---|---|---|---|---|---|---|
| | | Saturated charging amount under high temperature and high humidity (H/H) | | Difference in saturated charging amount between environments | | High temperature and high humidity (H/H) Rise of amount of toner to be charged on two-component developing sleeve (after 5 minutes/after 1 minute) | | (after 5 minutes/after 2 minutes) | |
| | | mC/Kg | Evaluation rank | (HH/LL) ratio | Evaluation rank | ratio | Evaluation rank | ratio | Evaluation rank |
| Example 1 | Toner 1 | −60.9 | A | 1.10 | A | 1.04 | A | 1.02 | A |
| Example 2 | Toner 2 | −58.9 | A | 1.13 | A | 1.05 | A | 1.03 | A |
| Example 3 | Toner 3 | −57.6 | A | 1.14 | A | 1.05 | A | 1.03 | A |

TABLE 5-continued

| | | Result of evaluation | | | | | | | |
|---|---|---|---|---|---|---|---|---|---|
| | | Saturated charging amount under high temperature and high humidity (H/H) | | Difference in saturated charging amount between environments | | High temperature and high humidity (H/H) Rise of amount of toner to be charged on two-component developing sleeve (after 5 minutes/after 1 minute) | | (after 5 minutes/after 2 minutes) | |
| | | mC/Kg | Evaluation rank | (HH/LL) ratio | Evaluation rank | ratio | Evaluation rank | ratio | Evaluation rank |
| Example 4 | Toner 4 | −48.6 | A | 1.12 | A | 1.08 | A | 1.05 | A |
| Example 5 | Toner 5 | −55.6 | A | 1.15 | A | 1.07 | A | 1.04 | A |
| Example 6 | Toner 6 | −54.0 | A | 1.12 | A | 1.10 | A | 1.05 | A |
| Example 7 | Toner 7 | −62.1 | A | 1.13 | A | 1.12 | A | 1.05 | A |
| Example 8 | Toner 8 | −62.4 | A | 1.14 | A | 1.10 | A | 1.04 | A |
| Example 9 | Toner 9 | −43.6 | A | 1.12 | A | 1.04 | A | 1.02 | A |
| Example 10 | Toner 10 | −38.5 | B | 1.21 | A | 1.23 | B | 1.16 | A |
| Example 11 | Toner 11 | −36.4 | B | 1.28 | A | 1.36 | B | 1.23 | B |
| Example 12 | Toner 12 | −28.6 | C | 1.41 | B | 1.50 | C | 1.35 | B |
| Example 13 | Toner 13 | −61.0 | A | 1.23 | A | 1.38 | B | 1.23 | B |
| Example 14 | Toner 14 | −62.5 | A | 1.45 | B | 1.42 | B | 1.27 | B |
| Example 15 | Toner 15 | −57.5 | A | 1.14 | A | 1.08 | A | 1.03 | A |
| Example 16 | Toner 16 | −56.8 | A | 1.13 | A | 1.06 | A | 1.02 | A |
| Example 17 | Toner 17 | −56.2 | A | 1.12 | A | 1.05 | A | 1.02 | A |
| Example 18 | Toner 18 | −37.2 | B | 1.18 | A | 1.26 | B | 1.15 | A |
| Example 19 | Toner 19 | −27.3 | C | 1.16 | A | 1.30 | B | 1.19 | A |
| Example 20 | Toner 20 | −26.5 | C | 1.20 | A | 1.45 | C | 1.26 | B |
| Example 21 | Toner 21 | −37.5 | B | 1.38 | B | 1.48 | C | 1.30 | B |
| Example 22 | Toner 22 | −38.0 | B | 1.20 | A | 1.23 | B | 1.14 | A |
| Example 23 | Toner 23 | −23.5 | C | 1.22 | A | 1.46 | C | 1.29 | B |
| Example 24 | Toner 24 | −18.5 | D | 1.20 | A | 1.65 | D | 1.38 | B |
| Example 25 | Toner 25 | −60.5 | A | 1.11 | A | 1.05 | A | 1.03 | A |
| Example 26 | Toner 26 | −61.3 | A | 1.12 | A | 1.06 | A | 1.02 | A |
| Example 27 | Toner 27 | −37.3 | B | 1.15 | A | 1.23 | B | 1.16 | A |
| Example 28 | Toner 28 | −35.0 | B | 1.20 | A | 1.28 | B | 1.18 | A |
| Comparative Example 1 | Toner 29 | −26.5 | C | 2.10 | D | 2.52 | E | 2.20 | E |
| Comparative Example 2 | Toner 30 | −35.5 | B | 1.75 | C | 1.90 | E | 1.63 | D |
| Comparative Example 3 | Toner 31 | −24.0 | C | 2.20 | D | 2.62 | E | 2.36 | E |
| Comparative Example 4 | Toner 32 | −9.0 | E | 1.30 | B | 1.85 | E | 1.64 | D |
| Comparative Example 5 | Toner 33 | −33.5 | B | 1.65 | C | 1.85 | E | 1.61 | D |

As above, the present invention can provide a toner in which the amount of the toner to be charged and rise of the amount of the toner to be charged are hardly influenced by change in a temperature or humidity environment.

REFERENCE SIGNS LIST

1 suction apparatus, 2 measuring container, 3 screen, 4 cover, 5 vacuum gauge, 6 wind amount control valve, 7 suction port, 8 capacitor, 9 electrometer While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-111618, filed May 18, 2011, which is hereby incorporated by reference herein in its entirety.

The invention claimed is:

1. A toner comprising toner particles, each of which contains a charging component and a colorant, wherein:

the toner contains a polymer having a partial structure represented by a following formula (1) as a side chain:

Formula (1)

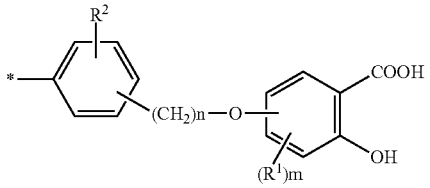

(wherein $R^1$ represents a hydroxyl group, a carboxyl group, an alkyl group having not less than 1 and not more than 18 carbon atoms, or an alkoxyl group having not less than 1 and not more than 18 carbon atoms;

$R^2$ represents a hydrogen atom, a hydroxyl group, an alkyl group having not less than 1 and not more than 18 carbon atoms, or an alkoxyl group having not less than 1 and not more than 18 carbon atoms;

m represents an integer of not less than 0 and not more than 3; if m is 2 or 3, $R^1$ can be each independently selected; n represents an integer of not less than 1 and not more than 3; and

* represents a coupling site in the polymer).

2. The toner according to claim 1, wherein the charging component is a resin having a polarity.

3. The toner according to claim 2, wherein an acid value of the resin is 2.0 mgKOH/g to 60.0 mgKOH/g.

4. The toner according to claim 1, wherein not less than 0.100 μmol and not more than 200 μmol of a partial structure represented by a formula (2) exists in the toner per 1 g of the toner:

Formula (2)

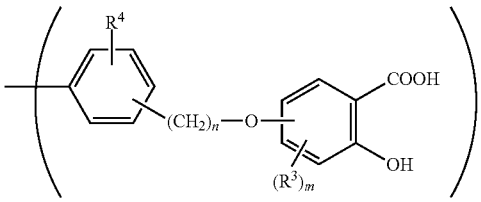

(wherein $R^3$ represents a hydroxyl group, a carboxyl group, an alkyl group having not less than 1 and not more than 18 carbon atoms, or an alkoxyl group having not less than 1 and not more than 18 carbon atoms;

$R^4$ represents a hydrogen atom, a hydroxyl group, an alkyl group having not less than 1 and not more than 18 carbon atoms, or an alkoxyl group having not less than 1 and not more than 18 carbon atoms;

m represents an integer of not less than 0 and not more than 3; if m is 2 or 3, $R^3$ can be each independently selected; and n represents an integer of not less than 1 and not more than 3).

5. The toner according to claim 1, wherein the toner further contains a polymer having the structure B represented by a formula (4):

Formula (4)

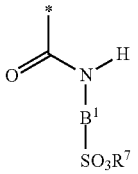

(wherein $R^7$ represents a hydrogen atom, or an alkyl group having 1 to 12 carbon atoms;

$B^1$ represents an alkylene structure that has 1 or 2 carbon atoms and may have a substituent, or an aromatic ring that may have a substituent; the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms; the substituent in the aromatic ring is a hydroxyl group, an alkyl group having not less than 1 and not more than 12 carbon atoms, or an alkoxyl group having not less than 1 and not more than 12 carbon atoms; and

* represents a coupling site in the polymer).

6. The toner according to claim 1, wherein:

the toner particles are obtained by granulating a monomer composition containing a polymerizable monomer and a colorant in an aqueous medium, and polymerizing the polymerizable monomer in the monomer composition, and a compound having a structure represented by a formula (3) is used as the polymerizable monomer:

Formula (3)

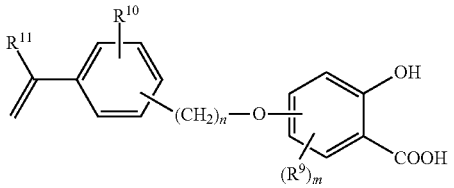

(wherein $R^9$ represents a hydroxyl group, a carboxyl group, an alkyl group having not less than 1 and not more than 18 carbon atoms, or an alkoxyl group having not less than 1 and not more than 18 carbon atoms;

$R^{10}$ represents a hydrogen atom, a hydroxyl group, an alkyl group having not less than 1 and not more than 18 carbon atoms, or an alkoxyl group having not less than 1 and not more than 18 carbon atoms;

$R^{11}$ represents a hydrogen atom or a methyl group;

m represents an integer of not less than 0 and not more than 3; if m is 2 or 3, $R^9$ can be each independently selected; and n represents an integer of not less than 1 and not more than 3).

7. The toner according to claim 1, wherein:

the toner particles is a toner obtained by polymerizing a polymerizable monomer in an aqueous medium in which core particles are dispersed, and a compound having the structure represented by the formula (3) is used as the polymerizable monomer:

Formula (3)

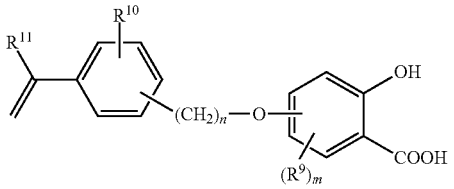

(wherein $R^9$ represents a hydroxyl group, a carboxyl group, an alkyl group having not less than 1 and not more than 18 carbon atoms, or an alkoxyl group having not less than 1 and not more than 18 carbon atoms;

$R^{10}$ represents a hydrogen atom, a hydroxyl group, an alkyl group having not less than 1 and not more than 18 carbon atoms, or an alkoxyl group having not less than 1 and not more than 18 carbon atoms;

$R^{11}$ represents a hydrogen atom or a methyl group;

m represents an integer of not less than 0 and not more than 3; if m is 2 or 3, R9 can be each independently selected; and n represents an integer of not less than 1 and not more than 3).

* * * * *